US006249664B1

(12) United States Patent
Sato

(10) Patent No.: US 6,249,664 B1
(45) Date of Patent: Jun. 19, 2001

(54) DEVELOPING APPARATUS HAVING TWO ROTORS FOR AGITATING AND CONVEYING DEVELOPER

(75) Inventor: Kazuhiko Sato, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/339,335

(22) Filed: Jun. 23, 1999

(30) Foreign Application Priority Data

Jun. 29, 1998 (JP) ..... 10-182253
Jul. 1, 1998 (JP) ..... 10-186305
Jul. 7, 1998 (JP) ..... 10-191501

(51) Int. Cl.[7] ..... G03G 15/08
(52) U.S. Cl. ..... 399/256; 399/254
(58) Field of Search ..... 399/254, 255, 399/256, 263

(56) References Cited

U.S. PATENT DOCUMENTS 4,864,349 * 9/1989 Ito ..... 399/256
5,294,968 * 3/1994 Ueda et al. ..... 399/256
5,510,883 * 4/1996 Kimura et al. ..... 399/256
5,572,299 * 11/1996 Kato et al. ..... 399/256
5,722,002 * 2/1998 Kikuta et al. ..... 399/256 X

* cited by examiner

*Primary Examiner*—Fred L Braun
(74) *Attorney, Agent, or Firm*—Jordan B. Bierman; Bierman, Muserlian and Lucas

(57) ABSTRACT

A developing device for developing an electrostatic latent image on a photoreceptor having an A-side and a B-side, the latter being located closer to the photoreceptor than the former. There is a developing cylinder at the B-side in close proximity to the photoreceptor to convey the developer toward the photoreceptor. A first agitating conveying rotator is at the A-side and for agitating developer, and a second agitating conveying rotator is between the developing sleeve and the first conveying rotator. The second rotator receives the developer from the first rotator, agitates the developer, and conveys the developer to the developing sleeve. Both rotate in the same direction to form a rotation locus, wherein the direction of the velocity vector tangent to the top of rotation locus is directed from the B-side toward the A-side.

16 Claims, 15 Drawing Sheets

DEVELOPING APPARATUS HAVING TWO ROTORS FOR AGITATING AND CONVEYING DEVELOPER

BACKGROUND OF THE INVENTION

The present invention relates to a developing apparatus which is provided on a copying machine of an electrophotographic system, a printer and on a facsimile machine and develops an electrostatic image, a developing method and an image forming apparatus, and in particular, to an improvement of a developing agent stirring and conveying device in the developing apparatus.

As a developing method used in an electrophotographic apparatus, there are known a regular developing method employed in an ordinary electrophotographic copying machine and a reversal developing method used in a digital printer and a digital electrophotographic copying machine. The reversal developing method is one wherein a laser and an LED are generally used as a light source, and a latent image formed on an image carrying member through charging and exposure is developed to be a toner image by toner charged to be in the same polarity as that of charges on the image carrying member. For example, when polarity of charges on the image carrying member is negative, polarity of toner is also negative, and development is made by the use of a voltage difference created by exposure to form a toner image on the image carrying member.

A transfer-accepting material is charged by a transfer unit employing corona discharge to be in polarity opposite to that of toner after development processing, and a toner image on the image carrying member is transferred onto the transfer-accepting material. After that, voltage of a transfer material is lowered by AC corona discharge or DC corona discharge to lower attraction between the transfer-accepting material and the image carrying member, and thereby the transfer-accepting material is exfoliated from the surface of the image carrying member to be ready for the following process.

In a conventional developing apparatus, a rotary developing agent carrying member is arranged in the vicinity of a rotary image carrying member. The developing agent carrying member is formed to be in the state of a hollow cylinder and is housed in a developing unit main body having an opening on its side facing the image carrying member. On the developing agent carrying member, there is impressed developing bias voltage in which AC voltage of 2700V and 8000 Hz is superposed on DC voltage, for example, of −600V. The developing agent carrying member has therein a fixed magnetic field generating means, and the outer circumferential surface of the developing agent carrying member carries two-component developing agent wherein toner particles and magnetic particles (carrier) are mixed.

The developing apparatus has therein a developing unit main body housing therein two-component developing agent which is composed of the toner and carrier, a developing agent carrying member representing a rotatable developing agent conveyance means, a developing agent supply member which supplies developing agent on the developing agent carrying member, a developing agent layer thickness regulating member which regulates a thickness of a developing agent layer on the developing agent carrying member, and a developing agent stirring and conveying member which stirs replenishing toner and developing agent and conveys developing agents to the developing agent supply member.

Toner replenished in the developing unit main body from a toner replenishing device through a toner replenishment inlet opened on the top of the developing unit main body is stirred by the rotating developing agent stirring and conveying member and mixed with developing agent contained in the developing unit main body to be of uniform toner concentration, and is supplied on the outer circumferential surface of the developing agent carrying member by the rotating developing agent supply member.

In recent years, there is a strong demand for colors even in these fields, and a color image forming method of an electrophotographic system and an apparatus employing that method are intensively studied. Among them, there is watched an image forming system (the so-called KNC system) wherein a series of steps to conduct uniform charging and imagewise exposure on an image carrying member are repeated to form superposed color images which are then transferred collectively onto a transfer body, because the mechanism of the image forming system is compact and images with high image quality can be obtained, and many technologies are studied.

Typical patents are disclosed in TOKKAISHO No. 60-76766 and others, and TOKKAISHO No. 60-95456 discloses a technology of an image forming method to make superposed color images by repeating twice or more the step to develop, on a non-contact basis, a latent image formed on the image carrying member, through vibrating electric field that is formed between a developing agent conveying carrier and an image carrying member, wherein an electrostatic latent image is made through dot exposure by a laser beam and dots each being for yellow, magenta and cyan are superposed, thus better image quality can be obtained.

In the KNC system mentioned above wherein a thin developing agent layer with a thickness of about 200–600 $\mu$m needs to be formed on the developing agent carrying member, it is extremely important, for obtaining stable images, to carry developing agents to the surface of the developing agent carrying member by stirring and conveying the developing agents without deteriorating them.

In an image forming apparatus such as a copying machine of an electrophotographic system and a printer, two-component developing agents in a developing apparatus which are stirred insufficiently and deteriorated cause problems including insufficient charging of developing agents, a fall of image density, mixing of color (neglected mixing of color) of toner images which is caused when image forming is resumed after suspension of image forming for a long time, a fall of reproduction of fine lines, contamination inside and outside a developing apparatus caused by scattering of suspended toner, and toner image failure (character ruggedness) on fine lines and on edge sections.

It is necessary to make a developing apparatus small for the purpose of miniaturizing an image forming apparatus such as a copying machine of an electrophotographic system and a printer. In a color image forming apparatus equipped with plural developing apparatuses, in particular, it is necessary to miniaturize a developing apparatus also for attaining an image carrying member having a small diameter. When a developing apparatus is made small, a space for housing a developing agent stirring and conveying member which stirs, mixes and conveys toner replenished in the developing apparatus and developing agent in the developing apparatus, is made small. Therefore, the developing agent stirring and conveying member needs to be made small. However, in the case of a conventional miniaturized developing agent stirring and conveying member, insufficient stirring is caused, uniform toner density can not be obtained due to insufficient stirring and mixing of developing agents, and distribution of charging amount is broadened in the course of running, resulting in a fall of developability in the course of development processing, a fall of image density, neglected mixing of color, a fall of reproducibility of fine lines, character ruggedness, image fogging, and scattering of suspended toner, thus, images are deteriorated.

SUMMARY OF THE INVENTION

The invention has been achieved to solve the problems stated above and its object is to provide a developing apparatus, a developing method and an image forming apparatus wherein a stirring means (a developing agent stirring and conveying member) is improved and thereby, replenished toner is sufficiently stirred and mixed before it is used for developing to raise an amount of charging to a prescribed level and to prevent character ruggedness, mixing of color and density variation, thus, an image with high image quality can be formed, and stable images can be obtained by reducing deterioration of developing agents.

The objects stated above can be attained by the following structure.

A developing device for developing an electrostatic latent image on a photoreceptor with developer, wherein the developing device has A-side and B-side and the B-side is located closer to the photoreceptor than the A-side, comprises:

- a developing cylinder located at the B-side in close proximity to the photoreceptor so as to convey the two component developer toward the photoreceptor;
- a first agitating conveying rotator located at the A-side and for agitating developer; and
- a second agitating conveying rotator located between the developing sleeve and the first agitating conveying rotator, for receiving the developer from the first agitating conveying rotator, for agitating the developer and for conveying the developer to the developing sleeve;
- the first agitating conveying rotator and the second agitating conveying rotator both rotating in the same direction to form a rotation locus, wherein the direction of velocity vector tangent to the rotation locus at the top of the rotation locus is directed from the B-side toward the A-side.

Further, the objects stated above can be attained by the following preferable structure.

(Structure 1)

A developing apparatus equipped with a rotatable developing agent carrying member (a developing cylinder) arranged to face an image carrying member (a photoreceptor) which carries an electrostatic latent image and with plural developing agent stirring and conveying members (an agitating conveying rotator) each having the axis of rotation which is in parallel with that of the developing agent carrying member, wherein the developing agent stirring and conveying member is composed of a first developing agent stirring and conveying member and a second developing agent stirring and conveying member which is arranged between the image carrying member and the first developing agent stirring and conveying member, and the direction of a velocity vector in the rotary tangential direction at the uppermost position in the vertical direction of each outer circumferential surface locus (a rotation locus) of each of the first developing agent stirring and conveying member and the second developing agent stirring and conveying member is directed to the farthest portion (A side) on the inner wall of a developing unit main body in the direction opposite to the side (B side) facing the developing agent carrying member.

(Structure 2)

A developing method which stirs and conveys both toner replenished from a toner replenishing device and developing agents in a developing apparatus and thereby to supplies them to a developing agent carrying member, wherein replenished toner and developing agents are stirred and conveyed by the first developing agent stirring and conveying member and the second developing agent stirring and conveying member each having the velocity vector in the rotary tangential direction described in Structure 1, and thereby, are supplied to the developing agent carrying member.

(Structure 3)

Developing agents are stirred, conveyed and supplied to a developing agent carrying member by the first developing agent stirring and conveying member and the second developing agent stirring and conveying member each having the velocity vector in the rotary tangential direction described in Structure 1, and thereby, a toner image is formed from an electrostatic latent image formed on an image carrying member, and then, the toner image is transferred onto a transfer-accepting material.

(Structure 4)

An image forming apparatus in which toner images each having a different color are formed to be superposed on an image carrying member by plural developing apparatuses each containing developing agent in a different color, and the superposed toner images are transferred onto a transfer-accepting material by a transfer means, wherein developing agents are stirred, conveyed and supplied to a developing agent carrying member by the first developing agent stirring and conveying member and the second developing agent stirring and conveying member each having the velocity vector in the rotary tangential direction described in Structure 1, and thereby, a toner image is formed, and then, the toner image is transferred onto a transfer-accepting material.

In the invention, each of the developing agent stirring and conveying member on the part of toner supply and the developing agent stirring and conveying member on the part of a developing agent carrying member is made to be optimum, with regard to the shape of a developing agent stirring and conveying member in the developing apparatus, and thereby, efficiency of stirring and conveying developing agents is improved and distribution of an amount of charging for developing agents is stabilized, resulting in solution of problems of a fall of image density, neglected mixing of color and a fall of reproduction of fine lines.

DETAILED DESCRIPTION OF THE PREFERRED EMBODIMENT

Figure 1:
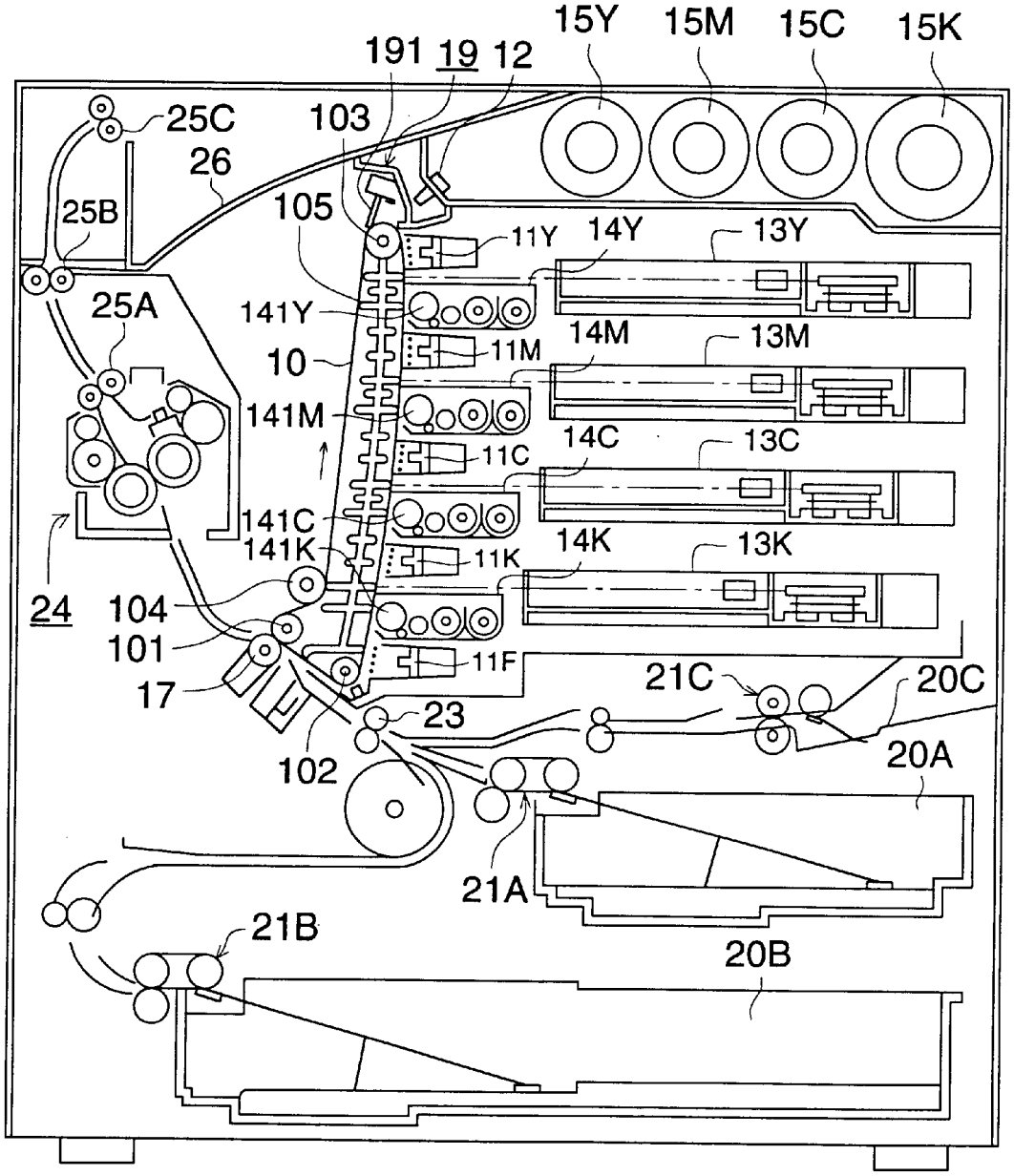
FIG. 1 is a sectional structure diagram of a color printer representing an example of an image forming apparatus equipped with a developing apparatus of the invention.

Hereinafter, the present invention will be explained with the reference to the drawings. However, the present invention is not limited to the embodiment shown in the drawings.

Prior to explanation of an embodiment of the invention, the structure of a color printer representing an example of an image forming apparatus equipped with plural developing apparatuses of the invention and its operations will be explained, referring to the sectional structure diagram in FIG. 1.

FIG. 1 is a sectional structure diagram showing a developing apparatus of the present embodiment and a color printer representing an image forming apparatus equipped with plural developing apparatuses of the invention.

This color printer is a color image forming apparatus wherein toner images each having a different color formed on an image carrying member in succession are superposed, then the toner images are transferred collectively onto a recording sheet to form a color image in the transfer section, and then, the recording sheet is exfoliated from the image carrying member.

This color printer is one wherein plural sets of image forming units (four sets shown on the diagram) are arranged in a single file on the circumference of a flexible and endless-belt-shaped photoreceptor (hereinafter referred to as a belt photoreceptor) 10 representing an image carrying member, and each set of image forming unit has therein each of four scorotron charging units (hereinafter referred to as a charging unit) 11Y, 11M, 11C and 11K, each of four imagewise exposure units 13Y, 13M, 13C and 13K, and each of four developing units 14Y, 14M, 14C and 14K. As an imagewise exposure unit 13 (Y, M, C and K), a laser beam scanning optical unit was used.

Belt photoreceptor 10 is trained about driving roller 101, and driven rollers 102 and 103, and it is tensed by an action of tension roller 104 to be rotated clockwise shown on the diagram, while touching locally backup member 105 provided along the inner circumferential surface of the belt photoreceptor. The backup member 105 touches the back side of the belt photoreceptor 10, and positions the belt photoreceptor 10 at the developing areas of developing agent carrying member (hereinafter referred to as a developing sleeve) 141 (Y, M, C and K) and at the image forming positions of imagewise exposure units 13 (Y, M, C and K).

In response to the start of image recording, a driving motor rotates, thereby, belt photoreceptor 10 is rotated in the clockwise direction shown on the diagram through driving roller 101, and charging unit 11Y starts giving voltage to the belt photoreceptor 10 through its charging operations. After the belt photoreceptor 10 is given voltage, exposure by an electric signal corresponding to an image signal of the first color signal, namely of yellow (Y) is started at imagewise exposure unit 13 Y, and thereby, rotation (sub-scanning) of the belt forms an electrostatic latent image corresponding to an image of yellow (Y) for the developed image on a photosensitive layer on the surface of the belt. This latent image is subjected to reversal development on a non-contact basis at the developing area by developing unit 14Y with developing agents stuck and conveyed to developing sleeve 141Y, and a toner image of yellow (Y) is formed in response to rotation of the belt photoreceptor 10.

Then, the belt photoreceptor 10 is further given voltage by charging operations of charging unit 11M on a yellow (Y) toner image, then there is conducted exposure by an electric signal corresponding to the second color signal, namely to an image signal of magenta (M) of imagewise exposure unit 13M, and a magenta (M) toner image is formed to be superposed on the yellow (Y) toner image by non-contact reversal development conducted by developing unit 14M.

In the same process, a cyan (C) toner image corresponding to the third color signal is formed by charging unit 11C, imagewise exposure unit 13C and developing unit 14C. Furthermore, a black (K) toner image corresponding to the fourth color signal is formed to be superposed in succession by charging unit 11K, imagewise exposure unit 13K and developing unit 14K, thus, a color toner image is formed on the circumferential surface of the belt photoreceptor 10 within one turn of the belt photoreceptor 10.

In developing operations of developing units 14Y, 14M, 14C and 14K, DC bias voltage with the same polarity as that in charging of belt photoreceptor 10 or developing bias voltage wherein AC bias is superposed on DC bias is impressed on each of developing sleeves 141Y, 141M, 141C and 141K, and non-contact reversal development with two-component developing agents sticking to each of developing sleeves 141 (Y, M, C and K) is conducted, and thereby, toner is stuck to the exposed portion on the belt photoreceptor 10.

A color toner image thus formed on the surface of the belt photoreceptor 10 is subjected to leveling of voltage of adhering toner by charging unit 11F, then is neutralized by a pre-transfer exposure unit, and is transferred, by transfer unit (transfer roller) 17 arranged to face the lower portion of driving roller 101 which drives the belt photoreceptor 10, onto a transfer sheet which is fed out by each of sheet-feeding means 21A, 21B and 21C from each of sheet-feeding cassettes 20A and 20B representing a sheet-feeding unit or from bypassed sheet-feeding section 20C, to be conveyed to paired registration rollers 23 and is fed in synchronization with a toner image area on the belt photoreceptor 10 by driving of the paired registration rollers 23, in the transfer section.

A transfer-accepting material (transfer sheet) onto which a toner image has been transferred is separated from the circumferential surface of the belt photoreceptor 10 which follows along the curve of the driving roller 101, then is conveyed to fixing unit 24 where toner is fused and fixed on the transfer sheet through heating and pressing in the fixing unit 24, and is ejected out of the fixing unit 24 to be conveyed by paired sheet-ejecting rollers 25A, 25B and 25C and to be ejected on sheet-ejecting tray 26 provided on the upper portion, with a toner image side of the transfer sheet facing downward.

On the other hand, the surface of the belt photoreceptor 10 from which the transfer sheet has been separated is scraped by cleaning blade 191 in cleaning unit 19 so that remaining toner thereon may be removed for cleaning to be ready to continue forming toner images of the following original images, or to be ready to stop momentarily to be on standby. Incidentally, when toner images of the following original images are formed in succession, the photoreceptor surface of the belt photoreceptor 10 is subjected to exposure conducted by pre-charging neutralizing unit 12, and hysteresis on the photoreceptor surface is removed.

Since the plural developing units 14Y, 14M, 14C and 14K are similar in terms of structure, these developing units will be called developing apparatus 14 in explanation of them.

Figure 2:
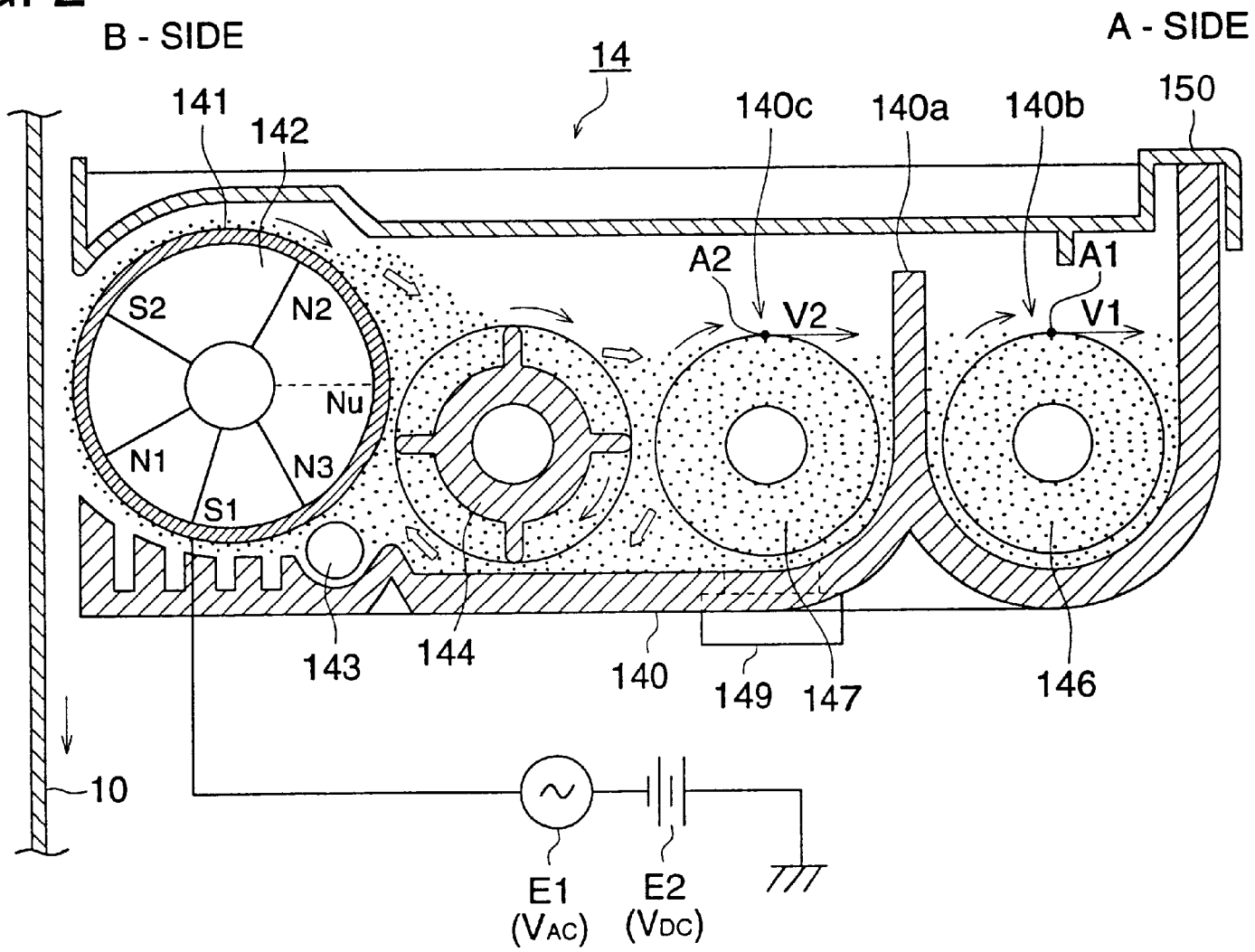
FIG. 2 is a sectional view of a developing apparatus.

FIG. 2 is a sectional view of the developing apparatus 14 of the invention.

In FIG. 2, the numeral 140 represents a developing unit main body which houses therein two-component developing agents composed of toner and carrier, the numeral 141 represents a developing sleeve, 142 represents a magnetic field generating means (hereinafter referred to as a magnet roll) which is arranged inside the developing sleeve 141 and fixed on the developing unit main body 140, 143 represents a developing agent layer thickness regulating member which regulates a thickness of a developing agent layer on the developing sleeve 141 to a prescribed thickness, and 144 represents a paddle-shaped developing agent supply member (a developer supplying collecting rotator, hereinafter referred to also as a paddle wheel) which supplies developing agents to the developing sleeve 141. Each of the numerals 146 and 147 is a screw-shaped developing agent stirring and conveying member, and 146 represents a first developing agent stirring and conveying member (hereinafter referred to as a toner supply side stirring screw), while 147 represents a second developing agent stirring and conveying member (hereinafter referred to as a sleeve side stirring screw).

Incidentally, the developing agent supply member 144 is not limited to the paddle wheel wherein plural paddle members are provided on the axis, but it may also take another shape which conveys developing agents efficiently. An illustrated arrow mark shows the direction of rotation of each roller. E1 represents AC power supply and E2 represents DC power supply.

Each of developing sleeves 141 (Y, M, C and K) of each of the developing units 14 (Y, M, C and K) has therein plural magnetic poles S1, S2, and N1–N3 as shown in FIG. 2, and magnetic poles N2 and N3 which are adjacent to each other and have the same polarity, among the plural magnetic poles, form a repelling magnetic field which strips off developing agents on each of the developing sleeves (Y, M, C and K) with a multiplier effect of the paddle wheel 144 arranged at the position satisfying the prescribed conditions stated later, and erases image hysteresis on the developing sleeve 141.

Figure 3:
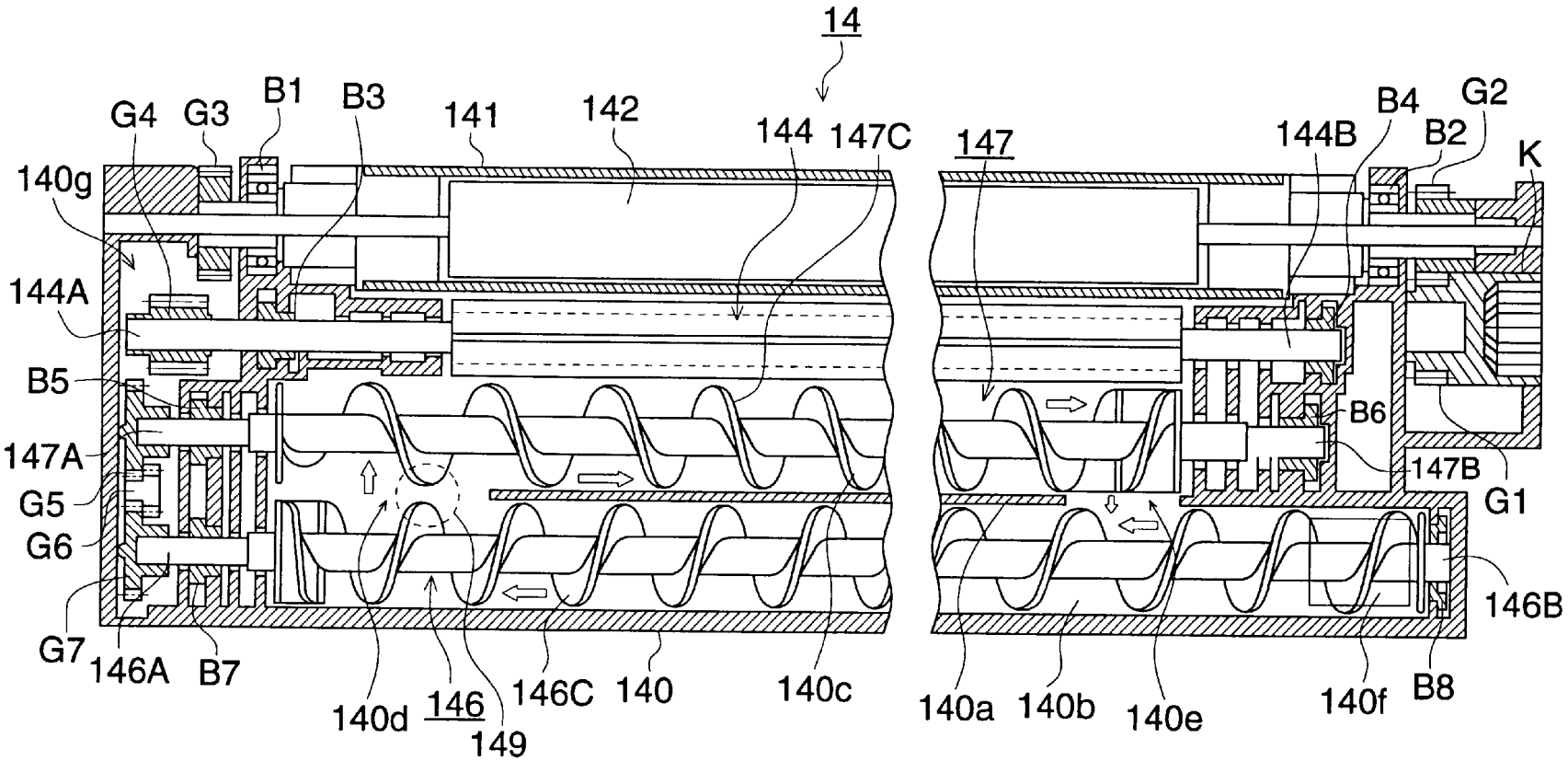
FIG. 3 is a horizontal sectional view of a developing apparatus.

The toner supply side stirring screw 146 and the sleeve side stirring screw 147 are arranged to be in parallel with each other respectively in first stirring chamber 140*b* and second stirring chamber 140*c* both formed on both sides of partition wall 140*a* erected from the bottom of the developing unit main body 140, and they are driven to rotate in the same direction by intermittent gear G6 shown in FIG. 3. Incidentally, screw-shaped spirals of the toner supply side stirring screw 146 and the sleeve side stirring screw 147 are formed to be opposite to each other in terms of direction, and therefore, the directions for conveying developing agents in the axial direction for both the toner supply side stirring screw 146 and the sleeve side stirring screw 147 are opposite to each other.

Upper portions of the first stirring chamber 140*b* and the second stirring chamber 140*c* are covered by upper cover member 150.

Toner replenished from toner cartridges 15Y, 15M, 15C and 15K is supplied in the first stirring chamber 140*b* for replenishment through toner replenishing inlet section (140*f* in FIG. 3) formed on the upper cover member 148 of developing apparatus 14.

In the developing sleeve 141, there is fixed magnet roll 142 wherein plural magnetic poles N1, N2, N3, S1 and S3 are arranged alternately. Among these plural magnetic poles, two poles N2 and N3 which are adjacent to each other are arranged to be of the same polarity, and these adjacent magnetic poles (strip off magnetic poles) N2 and N3 having the same polarity form the repelling magnetic field in which a strip off magnetic pole section which strips off developing agents on the developing sleeve 141 is formed.

It is preferable that an outside diameter of the developing sleeve 141 is within a range from ϕ 8 mm to ϕ 60 mm. When the outside diameter is ϕ 8 mm or more, it is possible to form magnet roll 142 having at least five magnetic poles composed of magnetic poles N1 and S2 which are needed for image forming, strip off magnetic poles N2 and N3, and magnetic pole S1. When the outside diameter of the developing sleeve 141 is ϕ 60 mm or less, it is effective to make a developing apparatus small. In particular, in a color printer (see FIG. 1) having plural sets of developing apparatuses (for example, developing units 14 (Y, M, C and K)), it is possible to shorten the belt photoreceptor 10 when plural developing apparatuses 14 are made small, thus, an image forming section may be made small.

FIG. 3 is a horizontal sectional view of developing apparatus 14 of the invention.

In FIG. 3, developing sleeve 141 is supported rotatably on its portions near its both ends which are held respectively by ball bearings B1 and B2. Both axial ends of magnet roll 142 having therein plural magnet poles are fixed. Gear G1 which is coaxial with coupling K connected to an unillustrated driving source rotates gear G2 which is fixed on an end on one side of the developing sleeve 141. Driving gear G3 fixed on the end on the other side of the developing sleeve 141 rotates driving gear G4 fixed on an end on one side of paddle wheel 144 through an unillustrated intermittent gear. The driving gear G4 transmits rotation to driving gear G5 fixed on rotary shaft section 147A of the sleeve side stirring screw 147 (hereinafter referred to also as stirring screw 147) through an unillustrated intermittent gear. The driving gear G5 transmits rotation to driving gear G7 fixed on rotary shaft section 146A of the toner supply side stirring screw 146 (hereinafter referred to also as stirring screw 146) through an intermittent gear (an idler gear).

Due to the rotation of gear G1, developing sleeve 141, paddle wheel 144 and stirring screws 146 and 147 are rotated simultaneously in the same arrowed direction shown in FIG. 2. Since the toner supply side stirring screw 146 and the sleeve side stirring screw 147 are formed to be opposite to each other in terms of the direction of screw spiral, supply toner and developing agents are conveyed to be circulated in the void arrow direction.

Stirring screw 146 accepts toner supplied from a toner supply unit through toner supply inlet section 140*f*, and conveys it in the rotation axis direction. The toner supply inlet section 140*f* is an end portion on one side of toner supply side stirring screw 146 where carrier in developing agents does not exist substantially.

The pointing direction of velocity vector V1 in the tangential direction of rotation at the uppermost position in the vertical direction A1 (hereinafter referred to as an uppermost end position A1) on the outer circumferential locus of toner supply side stirring screw 146 is opposite to the direction toward developing sleeve 141, and it is the direction to recede from the developing sleeve 141.

The pointing direction of velocity vector V2 in the tangential direction of rotation at the uppermost position in the vertical direction A2 (hereinafter referred to as an uppermost end position A2) on the outer circumferential locus of sleeve side stirring screw 147 is also opposite to the direction toward developing sleeve 141, and it is the direction to recede from the developing sleeve 141.

Therefore, the stirring screws 146 and 147 are rotated in the same direction. Further, the direction of rotation of the stirring screws 146 and 147 is the same as that of the developing sleeve 141. Incidentally, the surface of the developing sleeve 141 is moved in the direction opposite to that of movement of belt photoreceptor 10 at the position where the developing sleeve faces the belt photoreceptor (see FIG. 2).

Driving gears G3, G4, G5 and G7 and intermittent gear G6 are housed in driving section chamber 140*g* which is formed on one side of developing unit main body 140 by a partition wall.

Toner supplied to toner supply inlet section 140*f* from a toner supply unit composed of toner cartridges 16 (Y, M, C and K), an unillustrated toner hopper and a toner conveyance means, is conveyed in the direction of the rotation shaft of stirring screw 146 (an illustrated void arrow mark pointed to the left), while being stirred at the first stirring chamber 140*b* by the rotated stirring screw 146 together with developing agents contained in developing unit main body 140, then, passes through opening section 140*d* at the left edge of the end of partition wall 140*a*, and is conveyed to the second stirring chamber 140*c* (an illustrated upward void arrow mark).

Developing agents fed into the second stirring chamber 140*c* are stirred and conveyed by the rotated stirring screw 147 in the direction of its rotation axis (an illustrated void arrow mark pointed to the right) and are conveyed to the first stirring chamber 140*b* at opening section 140*e* on the illustrated right end (an illustrated downward void arrow mark).

Supplied toner is stirred, mixed and conveyed together with developing agents contained in the first stirring chamber 140*b* and the second stirring chamber 140*c*, and is supplied to developing sleeve 141 by paddle wheel 144.

Developing agents supplied to the circumferential surface of the developing sleeve 141 are regulated by developing agent layer thickness regulating member 143 to a prescribed amount in terms of a developing agent layer thickness, and then are subjected to development processing at the developing area facing belt photoreceptor 10. Developing agents remaining after the development processing are stripped off from the surface of the developing sleeve 141 by a repelling magnetic field formed by the aforesaid strip off magnetic poles N2 and N3, then are conveyed by paddle wheel 144 to sleeve side stirring screw 147 to be stirred.

On the bottom portion of the developing unit main body 140, there is fixed toner density detecting unit 149. The toner density detecting unit 149 is mounted on the second stirring chamber 140*c* or on the first stirring chamber 140*b* of the developing unit main body 140, and toner is supplied in the developing apparatus through toner supply inlet section 140*f* based on the results of detection made by the toner density detecting unit 149. The toner supply inlet section 140*f* is provided at the position where carrier in the developing agents does not substantially exist compared with an edge portion of the stirring screw 146 in the upstream side of the stirring screw 146.

Rotating shaft section 144A on one side of paddle wheel 144 is fitted in bearing-member B3 to be supported rotatably. Rotating shaft section 144B on the other side of the paddle wheel 144 is fitted in bearing member B4 to be supported rotatably.

Rotating shaft section 146A at a shaft end on one side of stirring screw 146 is fitted in bearing member B7 and rotating shaft section 146B at a shaft end on the other side is fitted in bearing member B8, and the stirring screw 146 is supported at its both ends rotatably. In the same way, rotating shaft sections 147A and 147B at both ends of stirring screw 147 are fitted respectively in bearing members B5 and B6, and are supported rotatably.

As a material for forming stirring screws 146 and 147, F-light FL 202 (made by NIHON FTB Co.) in which glass fibers are added to resins was used. In addition to this, F-light FL 302, F-light FL 201, F-light FL 362, F-light FL 201 (all made by NIHON FTB Co.) can be used. It is further possible to use resin materials such as ABS, denatured PPE, PC, PE, PETP, PF, POM, PS, PBT, PP, PA, PMMA, PAI, PPS, PPO, PAR, PSF, PES, PEI, POB and PEEK. It is still possible to use metals such as iron alloy, copper alloy, stainless steel, aluminum alloy and nickel alloy.

Paddle wheel 144 is formed by ABS resin or other resins, resins containing glass fibers, or metals.

Developing sleeve 141 is formed by stainless steel or aluminum alloy.

Figure 4:
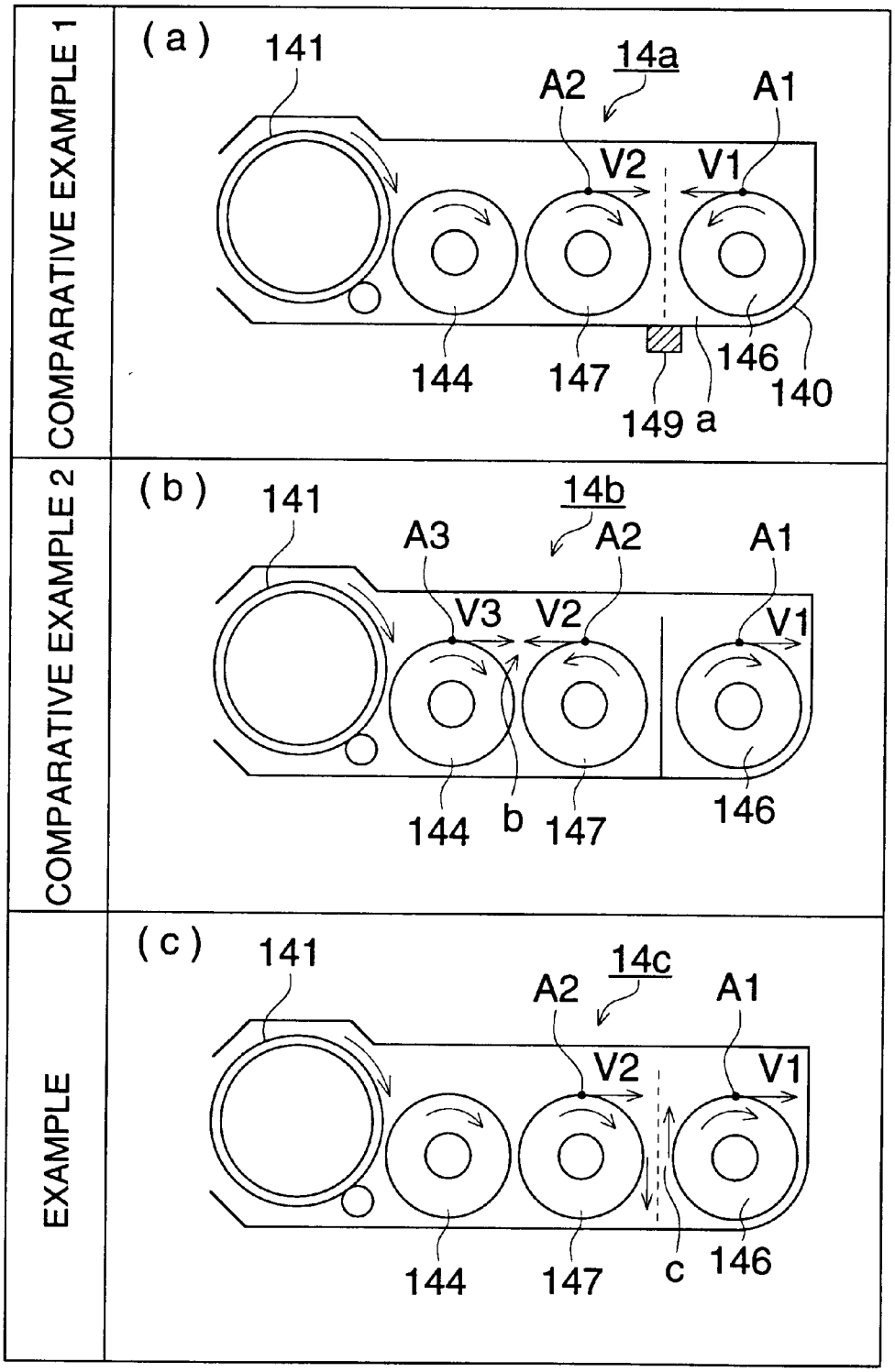
FIG. 4 shows illustrations of developing apparatuses in Comparative Example and Example.

FIG. 4 is an illustration diagram of developing apparatuses in a comparative example and the example. Rotation directions of stirring screws 146 and 147 in the comparative example and the example will be explained as follows with comparison.

In developing apparatus 14*a* of comparative example 1 shown in FIG. 4(*a*), sleeve side stirring screw 147 rotates in the same direction as in developing sleeve 141 and paddle wheel 144 (clockwise rotation shown in the diagram), while, toner supply side stirring screw 146 rotates in the opposite direction (counterclockwise rotation shown in the diagram).

Namely, the pointing direction of velocity vector V1 in the tangential direction of rotation at the uppermost position A1 of the stirring screw 146 is in the direction toward the position where developing sleeve 141 is arranged. On the contrary, the pointing direction of velocity vector V2 in the tangential direction of rotation at the uppermost position A2 of the sleeve side stirring screw 147 is in the direction which is opposite to the direction toward the position where developing sleeve 141 is arranged, and is the direction to recede from the developing sleeve 141.

Therefore, the pointing direction of velocity vector V1 at the uppermost position A1 of the stirring screw 146 is opposite to the pointing direction of velocity vector V2 at the uppermost position A2 of the stirring screw 147 as shown in the diagram.

In the developing apparatus 14*a* wherein stirring screws 146 and 147 are arranged to be in the directions stated above, developing agents are conveyed in the arrowed direction along velocity vectors V1 and V2 which face each other and then come to a halt on the upper portion of opening section 140*e* to cause insufficient mixing of developing agents at the opening section 140*e* where the stirring screws 146 and 147 which rotate in the opposite direction are close to each other and face to each other. In the developing apparatus 14*a* of this type, insufficient amount of charging of developing agents is caused at the start of driving, and a fall of an amount of charging is caused in the course of continuous developing. There are further caused problems such as image density variation, a fall of fine line reproducibility, and an increase of neglected mixing of color. Measurement of fluctuation of the amount of charging, the image density variation, the fall of fine line reproducibility and the increase of neglected mixing of color will be explained in the examples described afterwards.

Developing apparatus 14*b* in comparative example 2 shown in FIG. 4(*b*) is one wherein toner supply side stirring screw 146 rotates in the same direction as that of developing sleeve 141 and of paddle wheel 144 (illustrated rotation in the clockwise direction), while sleeve side stirring screw 147 rotates in the opposite direction (illustrated rotation in the counterclockwise direction).

Namely, the pointing direction of velocity vector V1 in the tangential direction of rotation at the uppermost position A1 of the stirring screw 146 is the direction to recede from the position where developing sleeve 141 is arranged, while the pointing direction of velocity vector V2 in the tangential direction of rotation at the uppermost position A2 of the sleeve side stirring screw 147 is the direction toward the position where the developing sleeve 141 is arranged.

Therefore, the pointing direction of velocity vector V1 at the uppermost position A1 of the stirring screw 146 is opposite to the pointing direction of velocity vector V2 at the uppermost position A2 of the stirring screw 147 to recede from each other as shown in the diagram. Incidentally, the pointing direction of velocity vector V3 at the uppermost position in the vertical direction of outer circumferential surface locus of paddle wheel 144 is the direction to recede from the position where the developing sleeve 141 is arranged.

In the developing apparatus 14*b* wherein stirring screw 147 and paddle wheel 144 are arranged to be in the opposite direction to each other as stated above, developing agents do not come to a halt at the upper portions of the opening sections 140*d* and 140*e*. However, at the upper position b of the portion where the stirring screw 147 and the paddle wheel 144 each rotating in the opposite direction face each other, developing agents conveyed in one direction collide with those conveyed in the other direction, resulting in serious deterioration of developing agents.

Therefore, insufficient amount of charging of developing agents is caused at the start of driving of developing apparatus 14*b*, and a fall of an amount of charging is caused in the course of continuous developing. There are further caused a fall of image density and a fall of image line width in the course of continuous forming of print images. There is further generated neglected mixing of color in the case of a color image forming apparatus.

Developing apparatus 14*c* in the example shown in FIG. 4(*c*) is one wherein toner supply side stirring screw 146 and sleeve side stirring screw 147 rotate in the same direction as that of developing sleeve 141 and of paddle wheel 144 (illustrated rotation in the clockwise direction).

Namely, the pointing direction of velocity vector V1 in the tangential direction of rotation at the uppermost position A1 of the stirring screw 146 is opposite to the arrangement position of developing sleeve 141 and is the direction to recede from the developing sleeve 141. Further, the pointing direction of velocity vector V2 in the tangential direction of rotation at the uppermost position A2 of the sleeve side stirring screw 147 is also opposite to the arrangement position of developing sleeve 141 and is the direction to recede from the developing sleeve 141.

Therefore, the pointing direction of velocity vector V1 at the uppermost position A1 of the stirring screw 146 is the same as the pointing direction of velocity vector V2 at the uppermost position A2 of the stirring screw 147 as shown in the diagram.

In the developing apparatus 14*c* wherein stirring screws 146 and 147 are arranged to be in the rotation direction stated above, the direction of flow of developing agents on the stirring screw 146 is vertically opposite as shown by arrow marks in the diagram to that of flow of developing agents on the stirring screw 147 at position c where the stirring screws 146 and 147 each rotating in the same direction face each other.

In opening section 140*e* located at an end of partition wall 140*a* shown in FIG. 3, developing agents conveyed by stirring screw 146 are transferred to stirring screw 147 without coming to a halt at the upper portion of the opening section 140*e* of developing unit main body 140, and thereby, developing agents containing supplied toner can be conveyed smoothly and are supplied to developing sleeve 141.

Insufficient amount of charging of developing agents at the start of driving of developing apparatus 14*c* and a fall of an amount of charging in the course of continuous developing are prevented. Since no developing agents are accumulated in the vicinity of a detection surface of toner density detecting unit 149 which is provided to be close to opening section 140*d*, toner density can be detected accurately, and neither a fall of image density nor a fall of image line width is caused in the course of continuous forming of print images. In addition, in the case of a color image forming apparatus, neglected mixing of color is hardly caused.

Specifications of constituting members for developing apparatus 14*c* representing an example are shown below.

Specifications of stirring screws 146 and 147

Outside diameter: 16 mm, Shaft diameter: 6 mm, Pitch: 14 mm

Speed of rotation: 200 rpm

Vector V1 of conveyance screw 146=10060 mm/sec

Vector V2 of conveyance screw 147=10060 mm/sec

Specifications of paddle wheel 144

Outside diameter: 14 mm, Shaft diameter: 6 mm, 4-blade type

Speed of rotation: 250 rpm

Velocity vector V3=11000 mm/sec

Specifications of developing sleeve 141

Outside diameter: 20 mm, Surface roughness Rz:=8 $\mu$m,

Magnetic pole arrangement: 5 poles

Speed of rotation: 350 rpm

Velocity vector V4=22000 mm/sec

Velocity vector ratio: V1:V2: V3:V4=1:1: 1.1:2.2

Developing efficiency of a developing apparatus of the invention will be explained, referring to examples.

In the present invention, the so-called two-component developing agents representing a combination of magnetic carrier and non-magnetic resin toner, especially a combination of coating magnetic carrier and non-magnetic toner can be used preferably. It is further possible to use two-component developing agents representing a combination of resin-dispersed magnetic carrier and non-magnetic resin toner.

As magnetic particles of carrier for developing agents (core material particle in the case of coating carrier), materials which have been known so far such as metals including iron, ferrite and magnetite, and alloys of the metals and other metals such as aluminum and lead, can be used. A volume mean particle diameter of carrier covering the core material particle is within a range of 10 μm–100 μm, and in particular, the volume mean particle diameter within a range of 20 μm–40 μm is preferable.

A preferable coating thickness is 0.5–3 μm, and conductive materials such as carbon may be added to resins. It is also possible to add silane coupling agents so that coating resins can be stuck to magnetic core materials.

Measurement of a volume mean particle diameter of carrier is typically conducted by a laser diffraction type grain size distribution measuring instrument "HELOS" (made by SYMPATEC Co.) equipped with a wet type dispersing machine.

A coulter counter is usually used for measurement of a volume mean particle diameter of toner. As a coulter counter, Coulter TA-11 (made by Coulter Co.), for example, is used. For the measurement, toner was dissolved in electrolyte ISOTONE-11 (made by Nikkaki Co.) to be dispersed, and the aforesaid coulter counter was used for measurement.

Comparative Test 1

Toner Saturation Time (Measurement of toner saturation time)

Toner to be supplied is put in toner supply inlet section 140*f*, and the time from stirring and mixing of the supplied toner and developing agents to the moment of arriving at a prescribed toner density value (toner saturation time) was measured. Judgment of the toner saturation depends on the voltage value obtained by measuring with a photometer. In the principle of operations of the photometer, a mixing degree of certain powder (density) is basically displayed as output voltage value of 0–5 V. Namely, when powder is not mixed sufficiently, there is caused dispersion of output voltage values. When powder is mixed sufficiently, output voltage values are uniformed. The period of time for the voltage value to be uniformed within a range of +5% is defined as toner saturation time.

Specifications of developing apparatus 14 are shown below.

Initial amount of developing agents in developing apparatus 14: 250 g.

Toner density in developing agents: 12%.

Toner to be supplied: 1 g.

Speed of rotation of developing sleeve 141: 350 rpm.

Speed of rotation of paddle wheel 144: 250 rpm.

TABLE 1

| Speed of rotation of stirring screw (rpm) | | 100 | 150 | 200 | 250 | 300 |
|---|---|---|---|---|---|---|
| Toner time saturation (sec) | Comparative Example 1 | 45 | 42 | 40 | 37 | 36 |
| | Comparative Example 2 | 30 | 27 | 25 | 22 | 22 |
| | Example | 6 | 5 | 5 | 4 | 4 |

In Table 1, there are summarized results of experiments and measurement of toner saturation time in three types of developing apparatuses (14*a*, 14*b* and 14*c*) in Comparative Example 1, Comparative Example 2 and Example.

Speed of rotation in each of stirring screws 146, 147 was changed at five steps within a range of 100–300 rpm, and toner saturation time in each developing apparatus of Comparative Example 1, Comparative Example 2 and Example was compared and studied.

As shown in Table 1, in Comparative Example 1 and Comparative Example 2, it takes time to stir and mix supplied toner and initial developing agents, and thereby, toner saturation time (time for output voltage to arrive at +5% or less) is as long as 22–45 sec. In developing apparatus 14*c* in Example of the invention, toner saturation time is 4–6 sec, and supplied toner is stirred and conveyed in an extremely short period of time to arrive at prescribed density value, which indicates that toner supply stirring efficiency in the developing apparatus 14*c* is high.

Comparative Test 2

Fluctuation in an Amount of Charging

By changing the stirring time by each of stirring screws 146 and 147, the relation between the stirring time and an amount of charging of developing agents was measured.

(How to measure an amount of charging)

An developing agent sample wherein toner and carrier are mixed is put in a cell which is for measurement in which a mesh screen made of stainless steel is set, and the sample is blown off for six seconds by nitrogen gas under the internal pressure of 0.2 kg/cm$^2$, and an amount of charging is measured from electric charges and mass of scattered powder.

(Relation between fluctuation of an amount of charging and stirring time)

Figure 5:
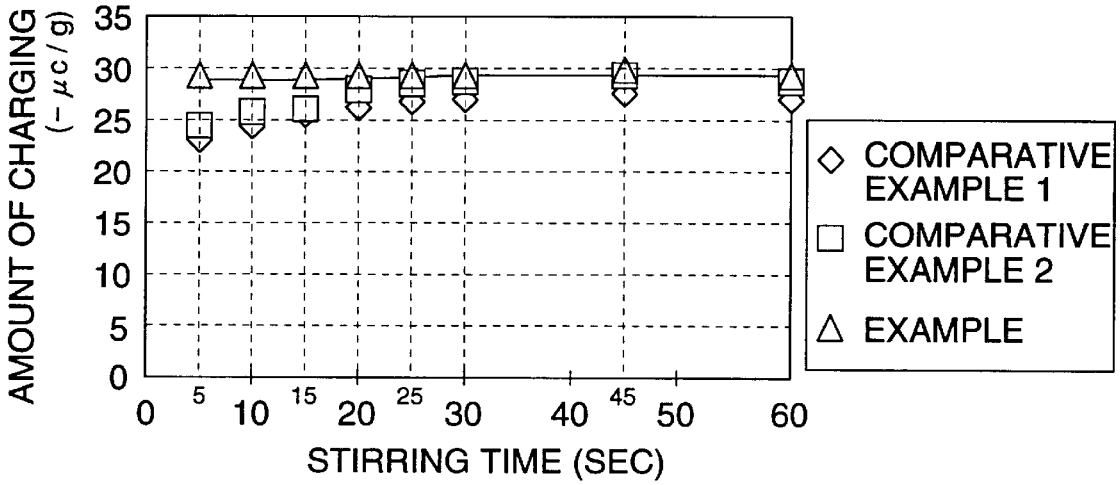
FIG. 5 is a diagram of characteristics showing the relation the stirring time by a stirring screw and variation of an amount of charging.
Figure 6:
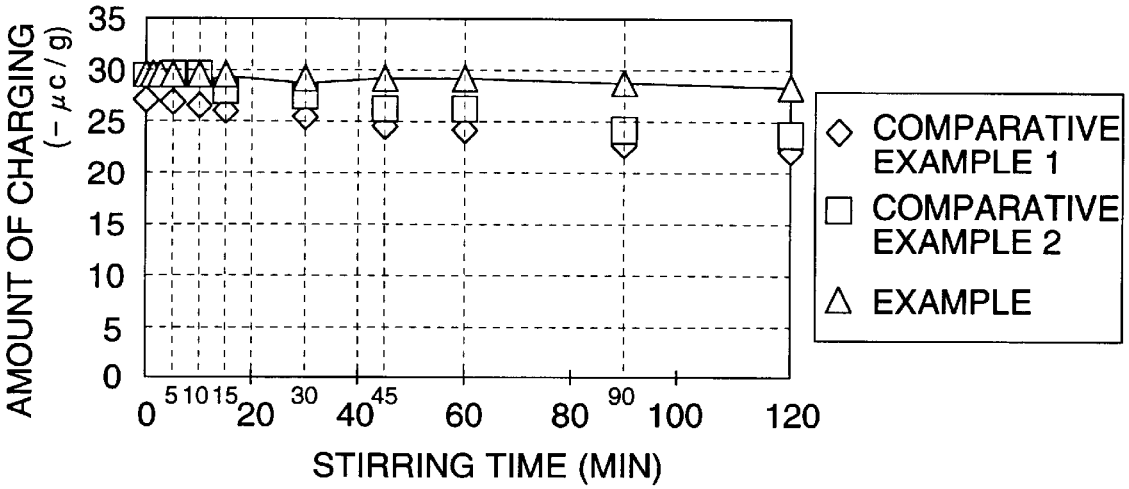
FIG. 6 is a diagram of characteristics showing the relation the stirring time by a stirring screw and variation of an amount of charging.

The developing apparatuses 14*a* (Comparative Example 1), 14*b* (Comparative Example 2) and 14*c* (Example) each being equipped with stirring screws 146 and 147 are rotated in the prescribed direction to stir and convey developing agents, thereby, the results of measurement and comparison of stirring time and an amount of charging made by the measuring instrument are shown in characteristics diagrams in Table 2 and FIGS. 5 and 6.

TABLE 2

| | Amount of charging (−μc/g) | | |
|---|---|---|---|
| Stirring time | Comparative Example 1 | Comparative Example 2 | Example |
| 5 sec. | 23.2 | 24.3 | 29.2 |
| 10 sec. | 24.6 | 25.6 | 29.4 |

TABLE 2-continued

| Stirring time | Amount of charging (−μc/g) Comparative Example 1 | Comparative Example 2 | Example |
|---|---|---|---|
| 15 sec. | 25.7 | 26.1 | 29.5 |
| 20 sec. | 26.1 | 27.6 | 29.7 |
| 25 sec. | 26.8 | 28.1 | 29.8 |
| 30 sec. | 27.3 | 28.9 | 29.8 |
| 45 sec. | 27.5 | 29.4 | 29.8 |
| 1 min. | 27.9 | 29.5 | 29.9 |
| 3 min. | 28.6 | 29.8 | 30.1 |
| 5 min. | 27 | 30 | 29.9 |
| 10 min. | 26.8 | 29.7 | 29.8 |
| 15 min. | 26.1 | 28.4 | 29.7 |
| 30 min. | 25.4 | 27.6 | 29.5 |
| 45 min. | 24.8 | 26.1 | 29.7 |
| 60 min. | 24.1 | 25.9 | 29.4 |
| 90 min. | 23.5 | 24.3 | 29.1 |
| 120 min. | 22.2 | 23.4 | 28.8 |

FIG. 5 shows a change of initial amount of charging within a range of stirring time from 5 sec to 60 sec. FIG. 6 shows a change of amount of charging within a range of stirring time from 1 min. to 120 min.

Tests up to 120 min. were made.

Table 2 is one wherein changes in amount of charging within a range of stirring time from 5 sec to 120 sec are tabulated.

In developing apparatus 14*a* in Comparative Example 1 and developing apparatus 14*b* in Comparative Example 2, a rise of an amount of charging in the start of the developing apparatus is slow as shown in FIG. 5, and a fall of an amount of charging in the case of continuous developing for a long time is great as shown in FIG. 6.

In developing apparatus 14*c* in Example, a rise of an amount of charging in the start of the developing apparatus is fast, and a fall of an amount of charging in the case of continuous developing for a long time is slight.

Comparative Test 3

Change in Image Density (Measurement of reflection density of print image)

A Macbeth reflection density meter was used for measurement.

Figure 7:
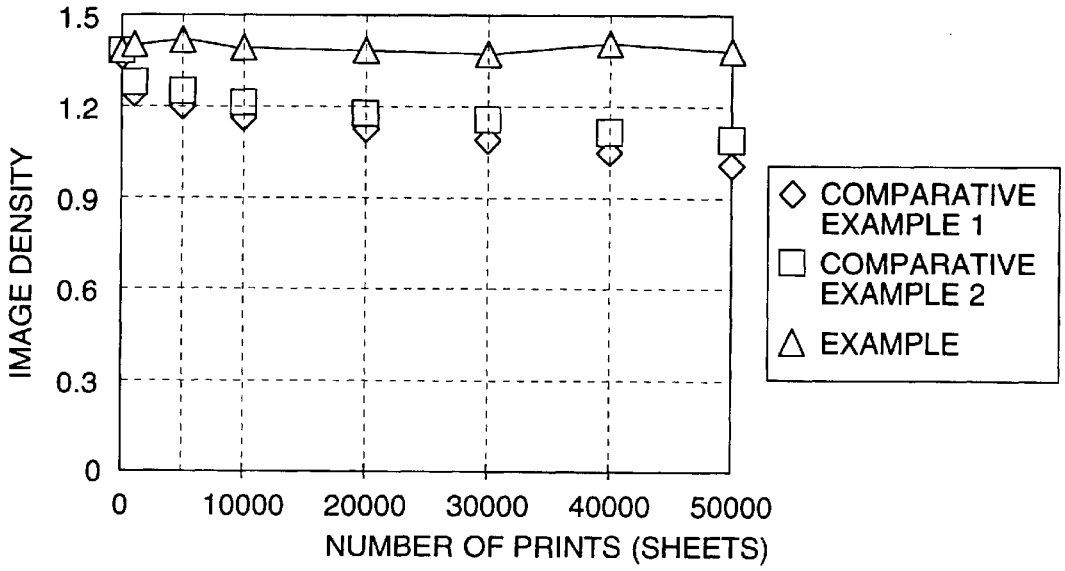
FIG. 7 is a diagram of characteristics showing the variation of reflection density on print images in the course of continuous printing for 50000 sheets of prints.

The developing apparatuses 14*a* (Comparative Example 1), 14*b* (Comparative Example 2) and 14*c* (Example) each being equipped with stirring screws 146 and 147 are rotated in the prescribed direction to stir and convey developing agents, thereby, the results of measurement and comparison of reflection density of images conducted by the thermometer after continuous printing by the use of an image forming apparatus in FIG. 1 are shown in characteristics diagrams in Table 3 and FIG. 7.

TABLE 3

| Number of prints (sheets) | Image density Comparative Example 1 | Comparative Example 2 | Example |
|---|---|---|---|
| 0 | 1.37 | 1.38 | 1.4 |
| 1000 | 1.25 | 1.28 | 1.41 |
| 5000 | 1.21 | 1.25 | 1.42 |
| 10000 | 1.17 | 1.21 | 1.4 |
| 20000 | 1.12 | 1.17 | 1.4 |
| 30000 | 1.08 | 1.15 | 1.38 |

TABLE 3-continued

| Number of prints (sheets) | Image density Comparative Example 1 | Comparative Example 2 | Example |
|---|---|---|---|
| 40000 | 1.05 | 1.11 | 1.4 |
| 50000 | 1 | 1.08 | 1.39 |

In developing apparatus 14*c* in Example, image density was hardly changed up to 50000 sheets of prints. In the Comparative Example 1 and Comparative Example 2, image density fell gradually, and the density value fell down to 1.38–1.0 when 50000 sheets of prints were made.

Comparative Test 4

Measurement of Neglected Mixing of Color (Measurement of neglected mixing of color)

After a yellow patch image was developed by developing unit 14Y, a microscope was used to enlarge and observe a mixing of color for black toner dispersed on the yellow patch image when the developed yellow patch image passed developing unit 14K on which developing bias voltage was impressed, and the number of mixing toner particles per 1 $mm^2$ at each of arbitrary 10 points was measured to evaluate the neglected mixing of color by taking an average value.

Figure 8:
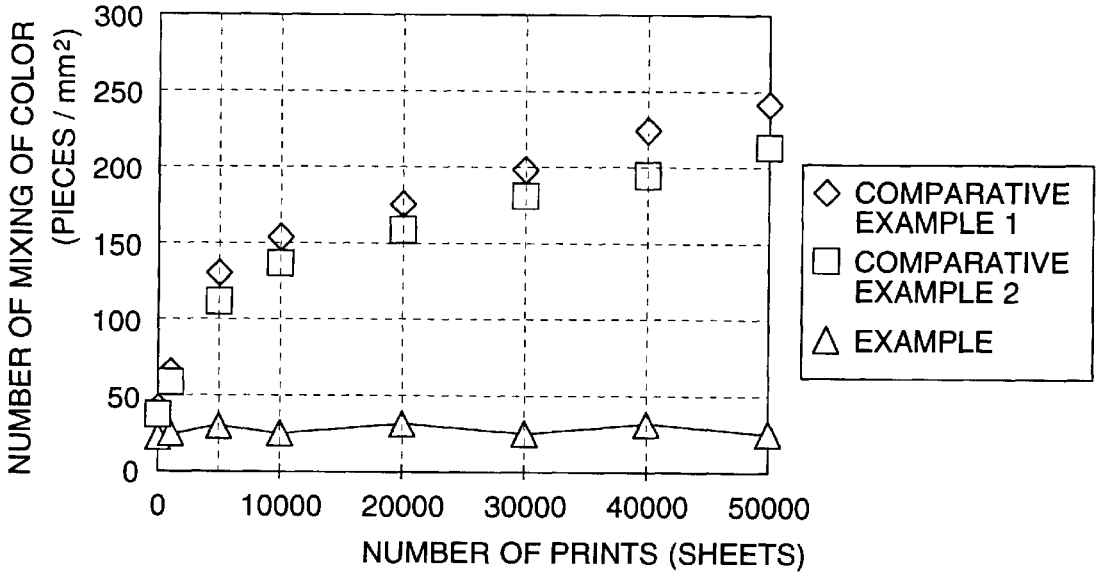
FIG. 8 is a diagram of characteristics showing the variation of mixing of color on print images in the course of continuous printing for 50000 sheets of prints.

Results of measurement and comparison of neglected mixing of color are shown in Table 4 and FIG. 8. For both of them, tests of up to 50000 prints were made.

TABLE 4

| Number of prints (sheets) | Mixing of color (pieces/$mm^2$) Comparative Example 1 | Comparative Example 2 | Example |
|---|---|---|---|
| 0 | 43 | 36 | 21 |
| 1000 | 64 | 59 | 25 |
| 5000 | 131 | 111 | 31 |
| 10000 | 154 | 135 | 25 |
| 20000 | 174 | 156 | 34 |
| 30000 | 196 | 178 | 29 |
| 40000 | 228 | 195 | 32 |
| 50000 | 243 | 210 | 31 |

In developing apparatus 14*c* in Example, the number of mixing of color was as small as 34 pieces/$mm^2$ or less up to 50000 prints and a change in the number of mixing of color was small even when the number of prints was increased, and exellent images were obtained. In Comparative Example 1 and Comparative Example 2, the number of mixing of color was as great as 36–243 pieces/$mm^2$, and in particular, the number of mixing os color was increased remarkably when the number of prints was increased, and deterioration of image quality was conspicuous.

Comparative Test 5

Fine Line Reproducibility (Measurement of fine line width)

There was outputted 2 dot (300 dpi)=170 μm line, and its image was enlarged by a microscope to measure a line width.

Figure 9:
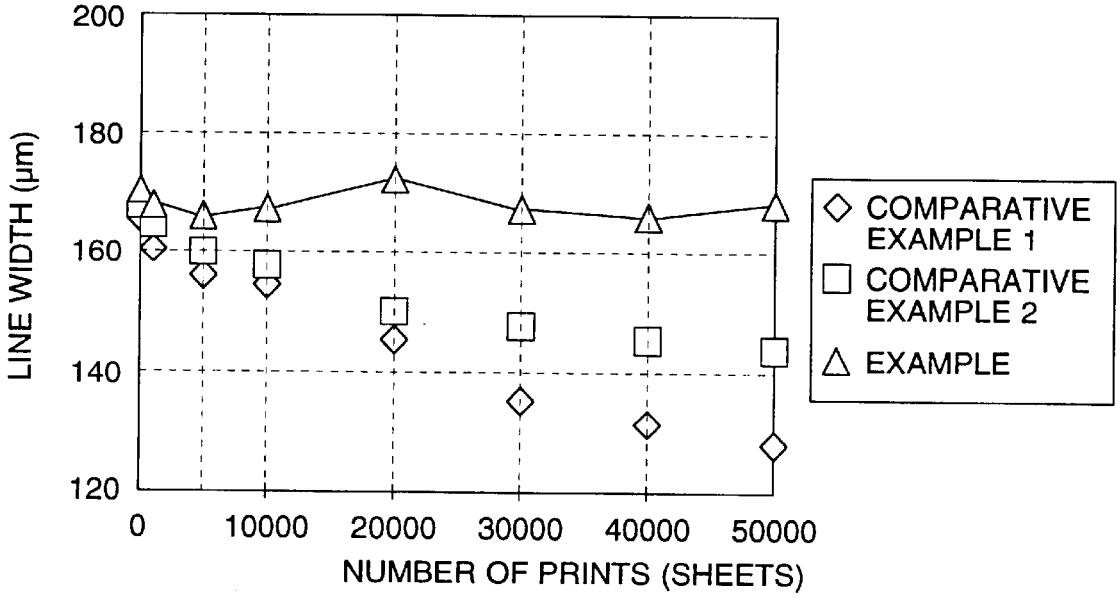
FIG. 9 is a diagram of characteristics showing the variation of fine line reproducibility on print images in the course of continuous printing for 50000 sheets of prints.

Results of measurement and comparison of a fine line width are shown in Table 5 and FIG. 9. For both of them, tests of up to 50000 prints were made.

TABLE 5

| Number of prints (sheets) | Fine line reproducibility (170 μm line) Comparative Example 1 | Comparative Example 2 | Example |
|---|---|---|---|
| 0 | 168 | 169 | 172 |
| 1000 | 161 | 165 | 169 |
| 5000 | 157 | 161 | 167 |
| 10000 | 155 | 158 | 168 |
| 20000 | 147 | 152 | 173 |
| 30000 | 135 | 148 | 168 |
| 40000 | 131 | 148 | 167 |
| 50000 | 128 | 143 | 169 |

In developing apparatus 14*c* in Example, a variation of a fine line width was within a range of 170±3 μm for the aforesaid 170 μm, and a change in a fine line width was small even when the number of prints was increased, and sharp and excellent images were obtained. In Comparative Example 1 and Comparative Example 2, the change in fine line width was as great as 128–169 μm, and in particular, a reduction of the fine line width was remarkable when the number of prints was increased, and deterioration of fine line reproducibility was conspicuous.

Next, improved points of the toner accepting section will be explained.

Figure 10:
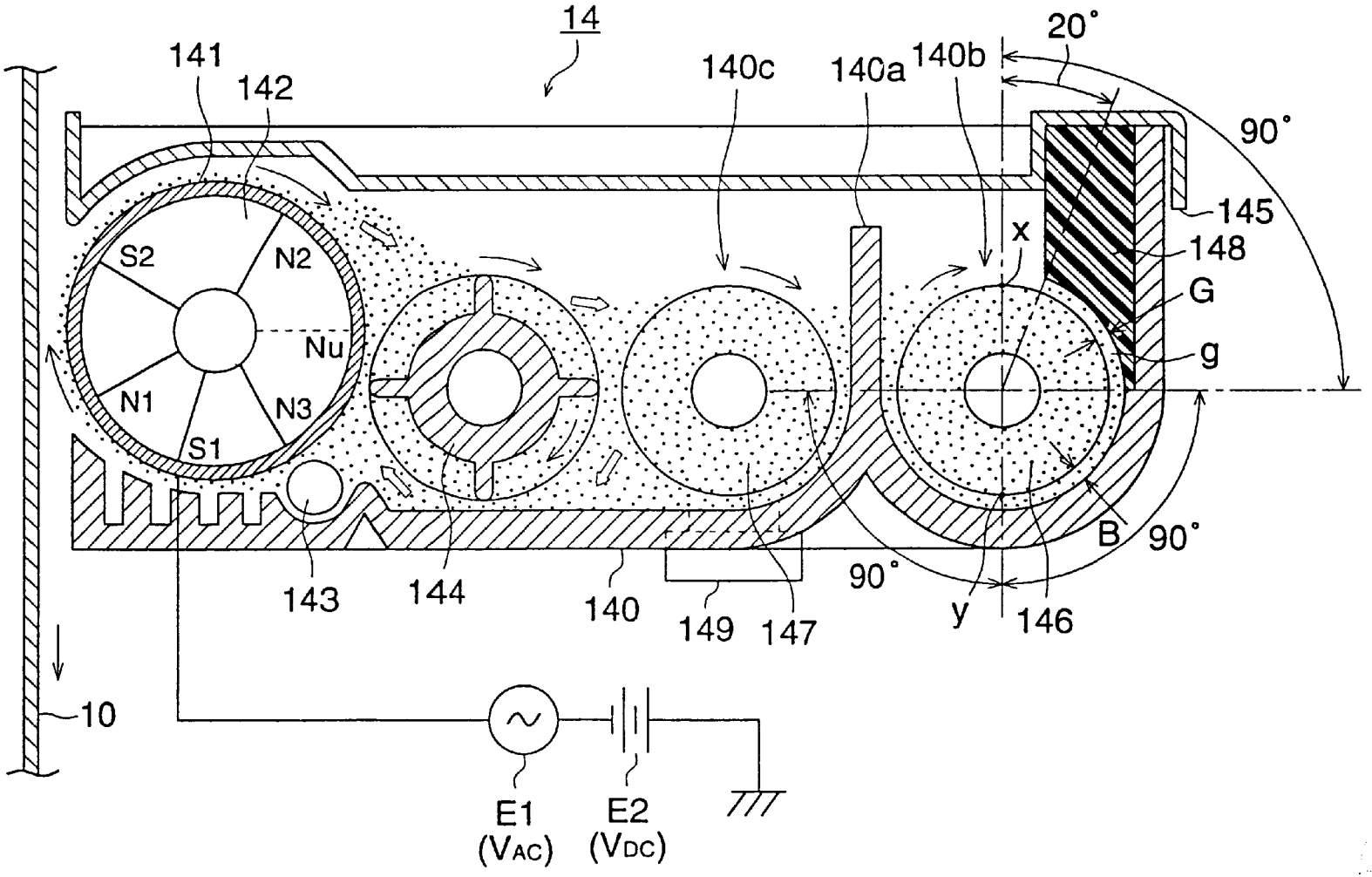
FIG. 10 is a sectional view of a developing apparatus showing the improved toner accepting section.

In FIG. 10, gap section g which is formed when an outer circumferential surface of first rotary member 146 arranged to be farthest from developing sleeve 141 is in close contact with an inner wall of developing unit main body 140 is formed within an angular range of 20°–90° in the rotation direction of the first rotary member 146 from its center of rotation, in the direction toward the inner wall of the developing unit main body 140 from the vicinity of uppermost position x in the vertical direction of the outer circumferential locus of the first rotary member 146, and a part of the outer circumferential section of the first rotary member 146 is covered through prescribed gap distance G in a way that gap distance G (μm) of the gap section g and volume mean particle diameter D (μm) of carrier particle in developing agents satisfy the following relational expression.

$$1 \times D \leqq G \leqq 300 \times D$$

(D=10–100 μm, G=20–3000 μm)

The gap distance G within a range of the aforesaid gap section g which faces the outer circumferential surface of the first rotary member 146 and the inner wall side of the developing unit main body 140 is formed by developing agent staying preventing member 148.

The developing agent staying preventing member 148 is provided to be united with upper cover member 145 which closes an upper opening of the developing unit main body 140. Or, it can be mounted on and dismounted from the inner wall of the developing unit main body 140. Or, it may be a separate molded member to be glued, or it may be united solidly with a developing unit main body, or glued thereon. Resins may be used as a material of the developing agent staying preventing member 148, and ABS resin or glass-fiber-containing resin is preferable. Further, non-magnetic metal can also be used.

By providing the developing agent staying preventing member 148, staying of developing agents and supplied toner stirred and conveyed to the upper portion on the side in the direction of rotation of the first rotary member 146 can be prevented, developing agents in developing apparatus 14 can be charged sufficiently, supplied toner can also be stirred and mixed sufficiently with developing agents in the developing apparatus 14, and thus, generation of non-charged or poorly charged developing agents can be restrained. When an amount of charging of developing agents in the developing apparatus 14 is made uniform, character ruggedness, mixing of color and density variation are caused less, and stable images can be obtained for a long time.

In FIG. 10, lower gap section g where an outer circumferential surface of first rotary member 146 arranged to be farthest from developing sleeve 141 is close to a lower inner wall of developing unit main body 140 is formed within an angular range of 90° in the regular and opposite rotation directions of the first rotary member 146 from its center of rotation, from the lowermost position y in the vertical direction of the outer circumferential locus of the first rotary member 146, and gap distance B (μm) of the gap section g is maintained in a way that it satisfies the following relational expression with volume mean particle diameter D (μm) of carrier particles.

$$1 \times D \leqq B \leqq 100 \times D$$

(D=10–100 μm, B=20–1500 μm)

Further, since an insufficient amount of charging for developing agents at the start of operation of developing apparatus 14 and a fall of an amount of charging in the course of continuous developing can be prevented, neither a fall of image density nor a fall of image line width is generated in the case of continuous print image forming. Further, in the case of a color image forming apparatus, generation of neglected mixing of color is also extremely rare.

Improved points stated above are structured as follows.

In a developing apparatus having therein a developing agent carrying member which is arranged to face an image carrying member that carries an electrostatic latent image and can rotate, a rotary member which is rotatably arranged to be in parallel with the rotation axis of the developing agent carrying member and can stir and convey two-component developing agents composed of carrier particles and toner particles, and a developing unit main body which houses therein the developing agent carrying member and the rotary member, the rotation direction at the uppermost position in the vertical direction of the outer circumferential locus of the rotary member arranged to face the inner wall of the developing unit main body Thai is farthest from the developing agent carrying member points to the farthest point on the inner wall of the developing unit main body in the direction opposite to that for facing the developing agent carrying member, an upper gap section is formed between the outer circumferential locus of the aforesaid rotary member and the inner wall of the developing main body within a range of rotation angle 20°–90° from the vicinity of the uppermost position in the vertical direction of the outer circumferential locus of the rotary member in the rotation direction of the rotary member, and gap distance G (μm) of the aforesaid upper gap section satisfies the following relational expression with volume mean particle diameter D (μm) of the carrier particles.

$$1 \times D \leqq G \leqq 300 \times D$$

(D=10–100 μm, G=20–3000 μm)

In a developing apparatus having therein a developing agent carrying member which is arranged to face an image carrying member that carries an electrostatic latent image and can rotate, plural rotary members which are rotatably arranged to be in parallel with the rotation axis of the developing agent carrying member and can stir and convey two-component developing agents composed of carrier particles and toner particles, and a developing unit main body which houses therein the developing agent carrying member and the plural rotary member, a lower gap section where an outer circumferential locus of the rotary member arranged to be farthest from the developing agent carrying member is close to the lower inner wall of the developing unit main body is formed within a range of angle 90° from the lowermost position in the vertical direction of an outer circumferential locus of the rotary member arranged to be farthest from the developing agent carrying member in the regular and opposite directions from the center of rotation of the rotary member, and gap distance B (μm) of the aforesaid gap section satisfies the following relational expression with volume mean particle diameter D (μm) of the carrier particles.

$$1\times D \leqq B \leqq 100\times D$$

(D=10–100 μm, B=20–1500 μm)

Next, improved points in arrangement of a paddle wheel will be explained.

Figure 11:
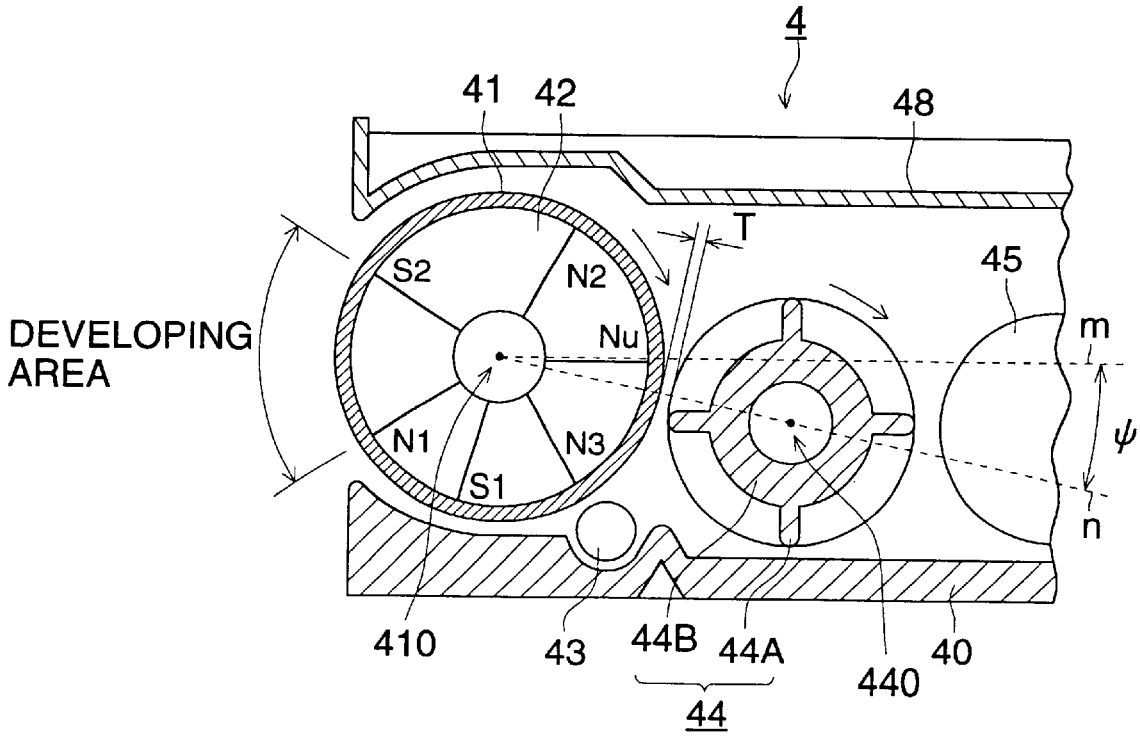
FIG. 11 is a partially enlarged section showing how the developing sleeve and the paddle wheel are arranged.

FIG. 11 is a partially enlarged section showing how the developing sleeve and the paddle wheel are arranged.

It is effective for preventing the occurrence of ghost that the shortest adjoining distance T (μm) between the outer circumferential surface of developing sleeve 41 and the locus of rotation of the tip portion of blade section 44A of the paddle wheel 44 is established for arrangement to satisfy the relational expression of $D \leqq T \leqq 150\times D$. In the expression, T represents the shortest adjoining distance (μm) between the outer circumferential surface of developing sleeve 41 and the locus of rotation of the paddle wheel 44, and D represents a volume mean particle diameter (μm) of carrier particles.

It is effective for preventing the occurrence of ghost that angle ψ formed between common normal line n passing through rotation shaft center 410 of developing sleeve 41 and rotation shaft center 440 of paddle wheel 44 and horizontal line m passing through the rotation shaft center 410 of developing sleeve 41 is within a range of setting angle 10°–90° in the gravity direction from horizontal line m.

It was confirmed in Example which will be described afterwards that the shortest adjoining distance T and the setting angle ψ both are within the aforesaid ranges are effective for developing characteristics.

Figure 12:
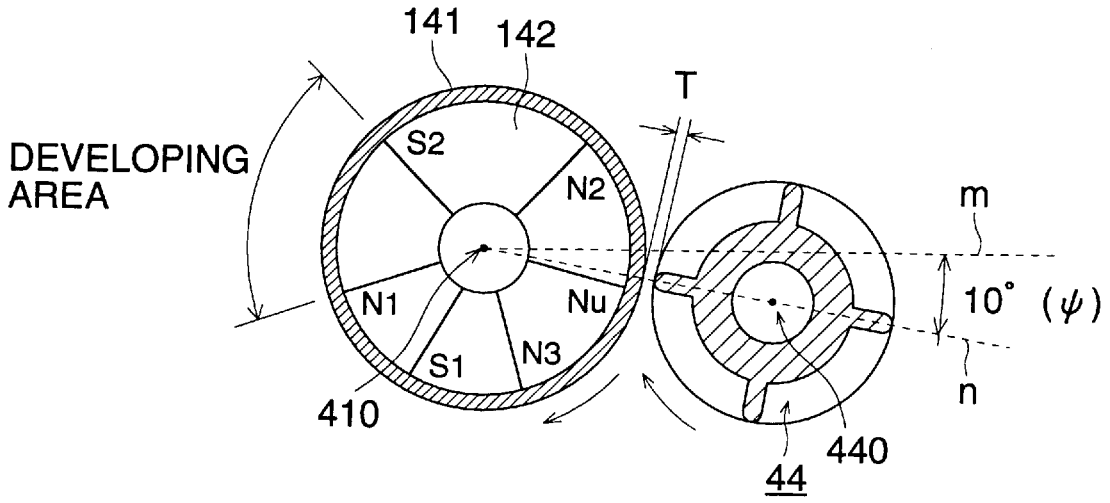
FIGS. 12(*a*) and 12(*b*) are sectional views showing the state of arrangement wherein the paddle wheel is set within a prescribed angular range from the developing sleeve.
Figure 12:
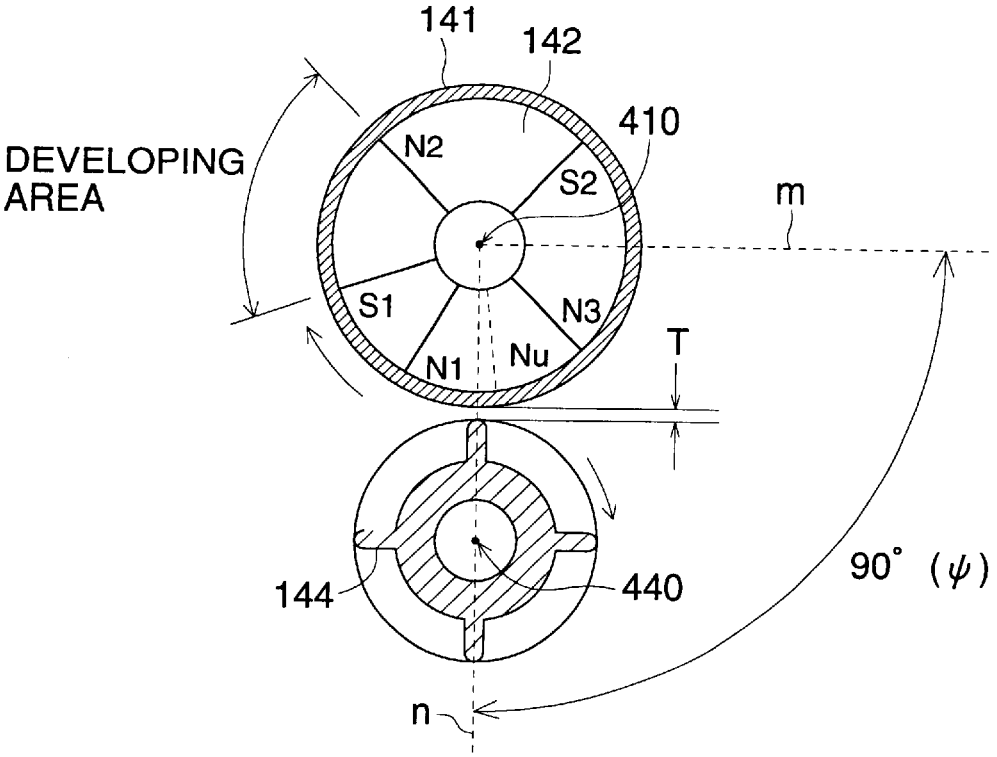

FIG. 12(*a*) is a sectional view showing the arrangement wherein rotation shaft center 440 of paddle wheel 44 is positioned to form setting angle ψ of 10° downward from horizontal line m which passes through rotation shaft center 410 of developing sleeve 41. In the vicinity of middle portion Nu between magnetic poles (strip off magnetic poles) N2 and N3 which form the repulsive magnetic field of magnet roll 42, there is formed the shortest adjoining distance T to face paddle wheel 44.

FIG. 12(*b*) is a sectional view showing the vertical arrangement wherein rotation shaft center 440 of paddle wheel 44 is positioned to form setting angle ψ of 90° downward from horizontal line m which passes through rotation shaft center 410 of developing sleeve 41. In the vicinity of middle portion Nu between magnetic poles (strip off magnetic poles) S2 and S3 which form the repulsive magnetic field of magnet roll 42, there is formed the shortest adjoining distance T to face paddle wheel 44.

(Definition of ghost and how to measure it)

Figure 13:
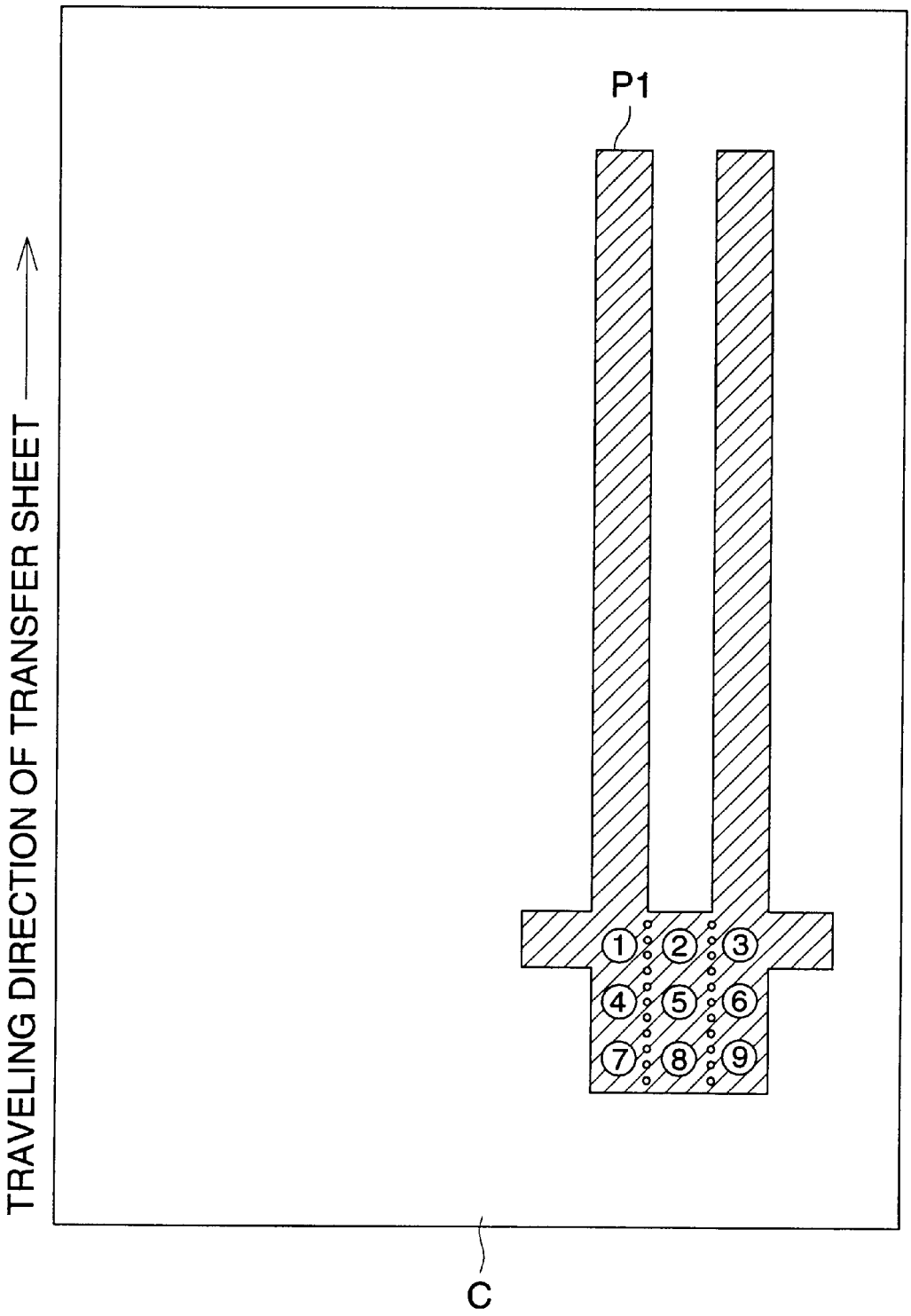
FIG. 13 is a diagram showing the image pattern for evaluation of ghost.

FIG. 13 is a diagram showing the image pattern for evaluation of ghost. This pattern was prepared by an apparatus to generate signals for image formation. A blackened portion in the diagram is solid black portion P1 of a transfer-accepting material having the transmission density of 1.4, and other blank portion is white area C.

The image pattern for evaluation of ghost mentioned above was subjected to printing out using black developing agents on the experimental machine of Konica KL-2010 Color Printer (made by Konica Corp.), and transmission density of the pattern formed on the transfer material was measured by the transmission density meter X-Rite 310 (made by X-Rite Co. in USA).

Each of illustrated (1), (2), (3), (4), (5), (6), (7), (8) and (9) shows a position to measure transmission density on the aforesaid solid black portion P1. On the central (2), (5) and (8) portions, sufficient image density can be obtained in the course of development processing, because the portions preceding the central portions are white areas and no developing agents are consumed. However, with regard to portions (1), (4) and (7) on the left side of the central portions and portions (3), (6) and (9) on the right side of the central portions, portions preceding them are black portions P1 where much developing agents are consumed, therefore, image density is lowered in the course of development processing on the aforesaid portions on the left side and right side of the central portions. Therefore, image density of each of portions (1), (4) and (7) on the left side and portions (3), (6) and (9) on the right side is lower than that of the central portions (2), (5) and (8) to create density difference, and to make an image to be light. An image on which a density difference is created is called a ghost.

Next, evaluation of image density difference will be described.

(Evaluation of density difference on solid black portion P1)

(How to evaluate ghost)

Image samples each being different in terms of transmission density are outputted by changing developing AC bias voltage (E1, E2) to be impressed on developing sleeve 41 and a distance between the surface of developing sleeve 41 and the surface of image carrying member (photoreceptor drum or belt photoreceptor) 1. These image samples are measured in the aforesaid measuring method to find transmission density difference Δ.

Figure 14:
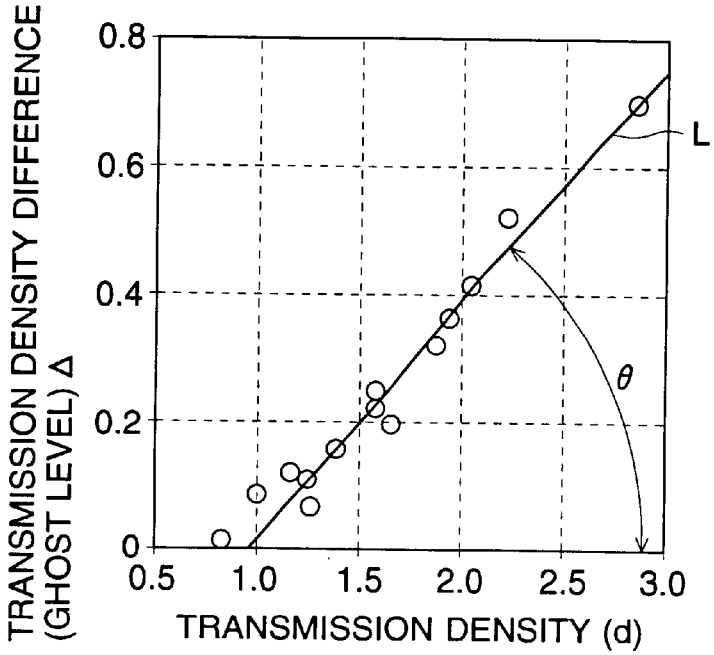
FIGS. 14(*a*) and 14(*b*) are diagrams of characteristics of transmission density difference in a developing apparatus.
Figure 14:
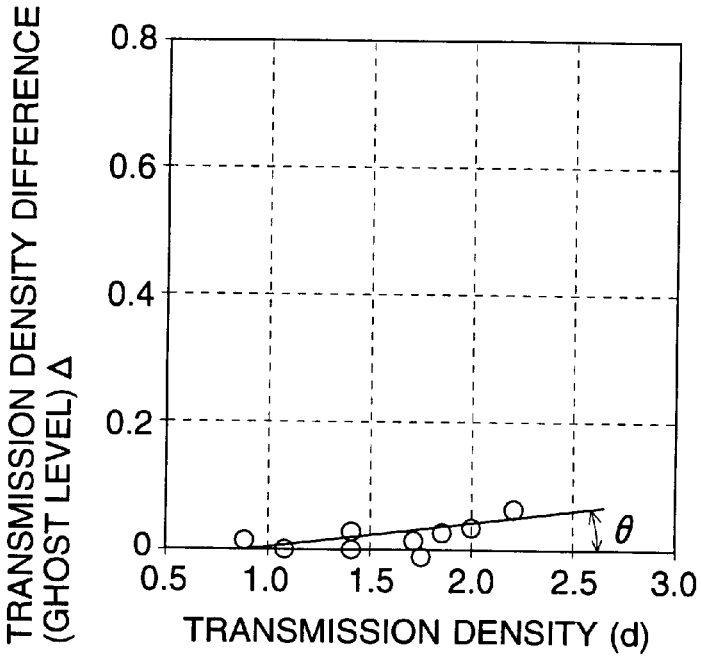

Transmission density difference $\Delta=\{[(2)-((1)+(3))/2]+[(5)-((4)+(6))/2]+[(8)-((7)+(9))/2]\}+3$ Five points or more for transmission density d of each image sample were outputted within a range of 1–2, then transmission density difference Δ was measured, and a diagram of characteristics shown in FIG. 14 was prepared.

FIG. 14(*a*) shows a diagram of characteristics of transmission density difference Δ in a developing apparatus of Comparative Example which will be explained afterwards. When transmission density differences Δ obtained by measuring transmission density d of each image sample within a range of 1–2 are plotted, the transmission density differences Δ are mostly positioned on straight line L which is expressed by expression of $\Delta=a\times d+e$ and is inclined by inclination angle θ. The symbol a in the expression represents an inclination angle (slope, tanθ) between the straight line L and the axis of abscissas x, and the symbol e is an intercept on the axis of ordinates of this straight line of characteristics.

In this case, "an excellent image without ghost" means transmission density difference Δ=0, namely, a=0. In other words, it means that the smaller the inclination a (tan θ) is, the better the ghost level is. When a certain ghost level is said to be excellent, the level is within a range of a<0.1 and it makes it impossible to observe ghost visually.

FIG. 14(*b*) shows a diagram of characteristics of transmission density difference Δ in a developing apparatus of the Example of the invention where developing sleeve 41 and paddle wheel 44 are regulated in terms of position of arrangement which will be explained afterwards. As illustrated, inclination a of the straight line of characteristics of each transmission density difference Δ is within a range of 0.1 or less, and images without ghost can be obtained.

For the purpose of conducting Comparative Test, developing sleeve 41 and paddle wheel 44 were arranged as follows in the developing apparatus explained in the aforesaid embodiment.

Specifications of developing sleeve 41

Outside diameter: ϕ20 mm

Surface roughness: Rz=8 μm

Material: Non-magnetic stainless steel (aluminum alloy and other metals can also be used)

Magnetic pole arrangement: 5 poles

Speed of rotation: 350 rpm

Specifications of paddle wheel (water wheel) 44

Outside diameter: ϕ14 mm

Rotating shaft diameter: ϕ6 mm

Number of blades on blade section 44A: 4 blades

Material: ABS resin (other resins, glass-containing resin and metals can also be used)

Speed of rotation: 250 rpm

Specifications of stirring screws 45 and 46

Outside diameter: ϕ16 mm

Rotating shaft diameter: ϕ6 mm

Pitch: 14 mm

Material: F-light (resin+glass added, made by Nihon FTB Co.)

Speed of rotation: 200 rpm

Structure of belt photoreceptor 1: OPC belt

Ratio of outside diameters of rotary members

Developing sleeve outside diameter : Paddle wheel outside diameter : Stirring screw outside diameter=1:0.7:0.8

Comparative Test 6

Study of Ghost 1

(Confirmation of shortest adjoining distance A of paddle wheel 44)

The shortest adjoining distance T between developing sleeve 41 and paddle wheel 44 was changed variously within a range of 0.5D–200D for experimental studies, and inclination angle θ of straight line L for transmission density difference Δ and inclination (ghost inclination) a both shown in FIG. 14 were obtained. The results of them are shown in Table 6.

Tolerance of ghost inclination (a range of inclination which can not be recognized visually) : a<0.1.

Setting angle for paddle wheel 44 : ψ=30°.

Diameter of carrier particle: D=30 μm.

Diameter of toner particle: 10 μm.

The symbol T represents the shortest adjoining distance (mm) between the outer circumferential surface of developing sleeve 41 and the rotational locus of paddle wheel 44, and D represents volume mean particle diameter (μm).

The symbol T which is shown on the second line from the top in Table 6 is shortest adjoining distance T (μm) which is obtained when volume mean particle diameter D of carrier is set to 30 μm.

TABLE 6

| | | ← GOOD → | | | | | | | | |
|---|---|---|---|---|---|---|---|---|---|---|
| Shortest adjoining distance T (μm) | 0.5D | 1D | 25D | 50D | 75D | 100D | 125D | 150D | 175D | 200D |
| Shortest adjoining distance T (μm) (D = 30 μm) | 15 | 30 | 750 | 1500 | 2250 | 3000 | 3750 | 4500 | 5250 | 6000 |
| Ghost inclination a (tan θ) | 0.005 | 0.005 | 0.005 | 0.007 | 0.012 | 0.02 | 0.03 | 0.05 | 0.15 | 0.3 |

When shortest adjoining distance T between developing sleeve 41 and paddle wheel 44 was set to 1D–150D, namely when the shortest adjoining distance T is set within a range of 30–4500 μm by selecting carrier with D=30 μm as shown in Table 6, there was formed an excellent image with high image quality wherein a tolerance of ghost inclination was a<0.1, and the occurrence of ghost explained in FIG. 13 was not observed visually. Within a range of T>150×D, ghost appeared on an image.

Incidentally, with regard to the shortest adjoining distance T, it is preferable to make this distance T to be 2000 μm or less, because a developing apparatus is required to be small in size and to be thin in thickness, when designing a developing apparatus small, especially in the case of a color image forming apparatus wherein plural developing apparatuses are arranged to be close to each other. When the shortest adjoining distance exceeds 150D, ghost inclination a is increased rapidly to lower image quality. Incidentally, it is hard, from the viewpoint of mechanical precision, to make the shortest adjoining distance T to be the shortest distance of 200 μm, when a rotational error of each of the developing sleeve 41 and the paddle wheel 44 is taken into consideration. However, if the precision can be maintained, a ghost level changes for the better.

Comparative Test 7

Study of Ghost 2

(Confirmation of angle ψ of paddle wheel 44)

Next, setting angle ψ formed by a rotation shaft center of developing sleeve 41 and a rotation shaft center of paddle wheel 44 was changed variously within an angular range of 0°–110° for horizontal edge portion m for experimental studies as shown in FIG. 12 in the developing apparatus in the embodiment stated above, and inclination angle θ of straight line L for transmission density difference Δ, namely, ghost inclination a (a=tan θ) was obtained. The results of them are shown in Table 7.

TABLE 7

| | | | ← GOOD → | | | | | | | | | | |
|---|---|---|---|---|---|---|---|---|---|---|---|---|---|
| Angle ψ | 0° | 5° | 10° | 20° | 30° | 40° | 50° | 60° | 70° | 80° | 90° | 100° | 110° |
| Ghost inclination (tan θ) | 0.35 | 0.26 | 0.08 | 0.015 | 0.005 | 0.005 | 0.007 | 0.009 | 0.012 | 0.015 | 0.05 | 0.15 | 0.25 |

Tolerance of ghost inclination: a<0.1.

Specifications of developing sleeve 41, paddle wheel 44 and stirring screws 45 and 46 are the same as those described above.

Diameter of carrier particle: D=30 μm.

Diameter of toner particle: 10 μm.

Shortest adjoining distance between paddle wheel 44 and developing sleeve 41: T=20×D.

The shortest adjoining distance under the condition of carrier particle diameter D=30 μm: T=600 μm.

When paddle wheel 44 is arranged so that angle ψ, is formed between common normal line n passing through rotation shaft center 410 of developing sleeve 41 and rotation shaft center 440 of paddle wheel 44 and horizontal line m passing through the rotation shaft center 410 of developing sleeve 41, and paddle wheel 44 is arranged to be in the gravity direction within a range of setting angle 10°–90° as shown in Table 7, FIG. 11 and FIG. 12, the tolerance of ghost level was a≦0.1 as shown in Table 7, and there were formed excellent images with high image quality which are free from occurrence of ghost explained in FIG. 13. On the contrary, when setting angle ψ of paddle wheel 44 is less than 10° and is more than 90°, ghost appeared on an image.

Improved points in arrangement of the paddle wheel stated above are structured as follows.

In a developing apparatus having therein a developing agent carrying member which is arranged to face an image carrying member carrying an electrostatic latent image and is supported rotatably, a magnetic field generating means wherein at least two poles adjoining each other are arranged to be of the same polarity among plural poles arranged in the developing agent carrying member, and a developing agent supply member which is arranged to be close to the developing agent carrying member and supplies developing agents including toner and carrier to the developing agent carrying member, shortest adjoining distance T (μm) between the outer circumferential surface of the developing agent carrying member and the rotational locus of the developing agent supply member and volume mean particle diameter D (μm) of the carrier satisfy the relational expression D≦T≦150×D, and the developing agent supply member is arranged to be within a setting angle range of 10°–90° in the gravity direction in the angle formed by a common normal line passing through the rotation shaft center of the developing agent carrying member and the rotation shaft center of the developing agent supply member and by the horizontal line passing through the rotation shaft center of the developing agent carrying member.

Figure 15:
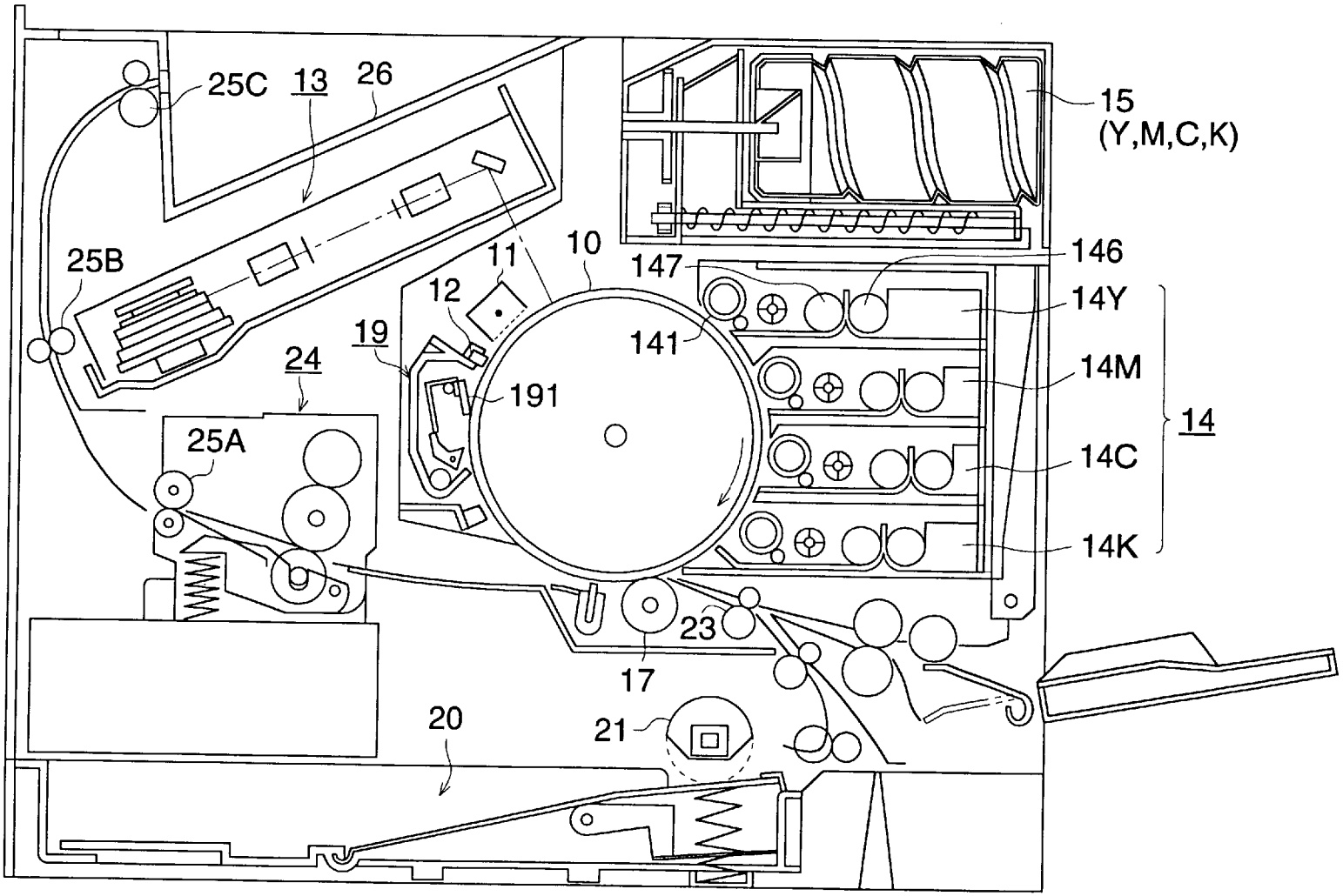
FIG. 15 is a sectional structure diagram showing another embodiment of a color printer equipped with a developing apparatus of the invention.

FIG. 15 is a sectional structure diagram showing an another embodiment of a color printer equipped with a developing apparatus of the invention. Incidentally, parts in FIG. 10 having the same functions as those in FIG. 1 are given the same symbols as in FIG. 1. Now, points which are different from the Embodiment 1 will be explained as follows.

This color printer is a color image forming apparatus wherein toner images each having a different color formed in succession on image carrying member (photoreceptor drum) 10 by one charging unit 11, one imagewise exposure unit 13 and four developing units 14 (Y, M, C and K) are superposed, then, they are transferred collectively onto a recording sheet at a transfer area to form a color image, and the transfer sheet is exfoliated from the surface of the image carrying member by an exfoliating means.

In FIG. 15, the numeral 10 is a photoreceptor drum representing an image carrying member which is constituted with an OPC photoreceptor (organic photoconductor) that is coated and formed on a drum base body and is grounded to be rotated clockwise in the diagram. The numeral 11 is a charging unit which gives uniform charging at high voltage $V_H$ to the circumferential surface of photoreceptor drum 10 by means of a grid which is held at grid voltage $V_G$ and of a corona discharge wire for corona discharge. Prior to charging conducted by this charging unit 11, the circumferential surface of a photoreceptor is neutralized by exposure conducted by pre-charging neutralizing unit (PCL) 12 employing a light emitting diode so that hysteresis of the preceding print and theretofore on the photoreceptor may be eliminated. The hysteresis on the photoreceptor mentioned above is also called a photoreceptor memory, and it means an image pattern which is formed through charging and imagewise exposure in the course of preceding image forming, and is left on the photoreceptor.

After the uniform charging on the photoreceptor drum 10, imagewise exposure unit 13 conducts imagewise exposure on the photoreceptor drum 10 based on image signals. The imagewise exposure unit 13 is one wherein an unillustrated laser diode is a light emitting light source, and an optical path from the light source passes through a rotating polygon mirror, fθ lens and cylindrical lens, and is deviated by a reflection mirror for scanning, and a latent image is formed when the photoreceptor drum 10 is rotated. In the present embodiment, exposure is conducted on the character section to form a reversal latent image wherein exposure section voltage $V_L$ is lower than charging voltage $V_H$.

There is provided, to surround the photoreceptor drum 10, developing apparatus 14 which is composed of developing units 14Y, 14M, 14C and 14K each housing therein two-component developing agents including carrier and yellow (Y) toner, magenta (M) toner, cyan (C) toner or black (K) toner. In each of the developing units 14Y, 14M, 14C and 14K, there are provided toner supply side stirring screw 146 and sleeve side stirring screw 147 each having the velocity vector direction of the invention.

Figure 16:
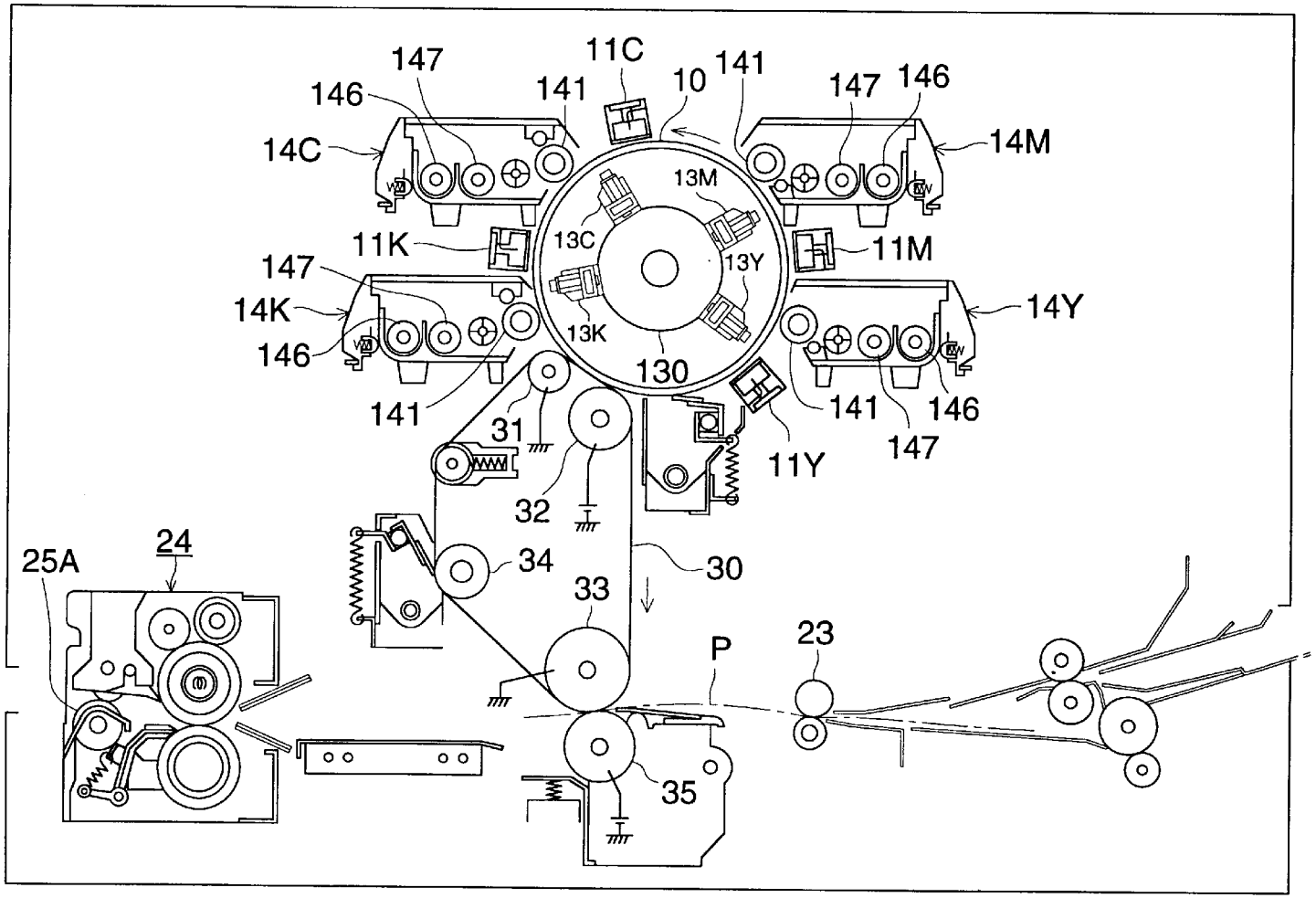
FIG. 16 is a sectional structure diagram showing still another embodiment of a color printer equipped with a developing apparatus of the invention.

FIG. 16 is a sectional structure diagram showing still another embodiment of a color printer equipped with a developing apparatus of the invention. Incidentally, parts in FIG. 11 having the same functions as those in FIG. 1 are given the same symbols as in FIG. 1. Now, points which are different from the Embodiment 1 will be explained as follows.

Photoreceptor drum 10 representing a drum-shaped image carrying member is one wherein a cylindrical transparent resin base body made of transparent member of transparent acrylic resin, for example, is provided in its inside, and transparent conductive layer and an organic photoconductor layer (OPC) are formed on the outer circumferential surface of the base body, and the photoreceptor drum 10 is grounded to be rotated in the direction shown with an arrow mark in FIG. 16.

A color image forming apparatus related to the invention is a color printer equipped with an image forming unit wherein plural charging units 11 (Y, M, C and K) and plural developing units 14 (Y, M, C and K) are arranged on an outer circumferential surface of the photoreceptor drum 10, and plural imagewise exposure unit 13 (Y, M, C and K) are arranged on an inner circumferential surface of the photoreceptor drum 10.

Each of the charging units 11 (Y, M, C and K) conducts charging operations on the organic photoconductor layer of the photoreceptor drum 10 by means of a grid held at prescribed voltage and a discharge wire for corona discharge, to give uniform voltage to the photoreceptor drum 10.

Imagewise exposure units which conduct imagewise exposure based on image signals are represented by 13Y, 13M, 13C and 13K, and image signals for each color which are read by a separate reading apparatus are taken successively out of a memory and are inputted in each of the imagewise exposure units 13 (Y, M, C and K) as electric signals by an exposure optical system composed of an LED arranged in the axial direction of the photoreceptor drum 10 and of a SELFOC lens of a life-size image forming system, thus, a latent image is formed through rotation (scanning) of the photoreceptor drum 10. Each of the imagewise exposure units 13 (Y, M, C and K) is mounted on supporting member 130 provided as an optical system supporting means to be housed in the transparent base body of the photoreceptor drum 10.

Each of the developing units 14 (Y, M, C and K) conducts non-contact reversal development, by impressing developing bias voltage, for a latent image formed on the photoreceptor drum 10 through charging by each of the charging units 11 (Y, M, C and K) and imagewise exposure by each of the imagewise exposure units 13 (Y, M, C and K). In each of the developing units 14Y, 14M, 14C and 14K, there are provided toner supply side stirring screw 146 and sleeve side stirring screw 147.

For developing operations for each of the developing units 14 (Y, M, C and K), DC developing bias or developing bias wherein AC voltage is further added to DC voltage is impressed on each developing sleeve 141, and thus, the photoreceptor drum 10 is subjected to non-contact reversal development with two-component developing agents contained in each of the developing units 14 (Y, M, C and K).

A color toner image formed on the circumferential surface of the photoreceptor drum 10 is transferred temporarily onto the circumferential surface of intermittent transfer belt 30 provided as an intermittent transfer means.

The intermittent transfer belt 30 is trained about rollers 31, 32, 33 and 34, and is conveyed in circulation in the clockwise direction by power transmitted to the roller 34, in synchronization with peripheral speed of the photoreceptor drum 10.

On the other hand, transfer sheet P is fed out by operations of a sheet-feeding roller of a sheet-feeding cassette, and then is fed by timing roller 23 to be conveyed to the transfer area on transfer roller 35 in synchronization with the conveyance of the color toner image on the intermittent transfer belt 30.

The transfer roller 35 is rotated counterclockwise in synchronization with peripheral speed of intermittent transfer belt 30, while transfer sheet P fed out is brought into close contact with a color toner image on the intermittent transfer belt 30 at the transfer area where a nip section is formed between the transfer roller 35 and roller 33 which is grounded, thus, the color toner image is transferred onto the transfer sheet P in succession through impression of bias voltage at 1–2 kV with polarity opposite to that of toner on the transfer roller 35.

The transfer sheet P onto which the color toner image has been transferred is neutralized, and then is conveyed to fixing unit 24 where toner is heated and fixed, and the transfer sheet is ejected out of the apparatus through sheet ejection roller 25A.

Figure 17:
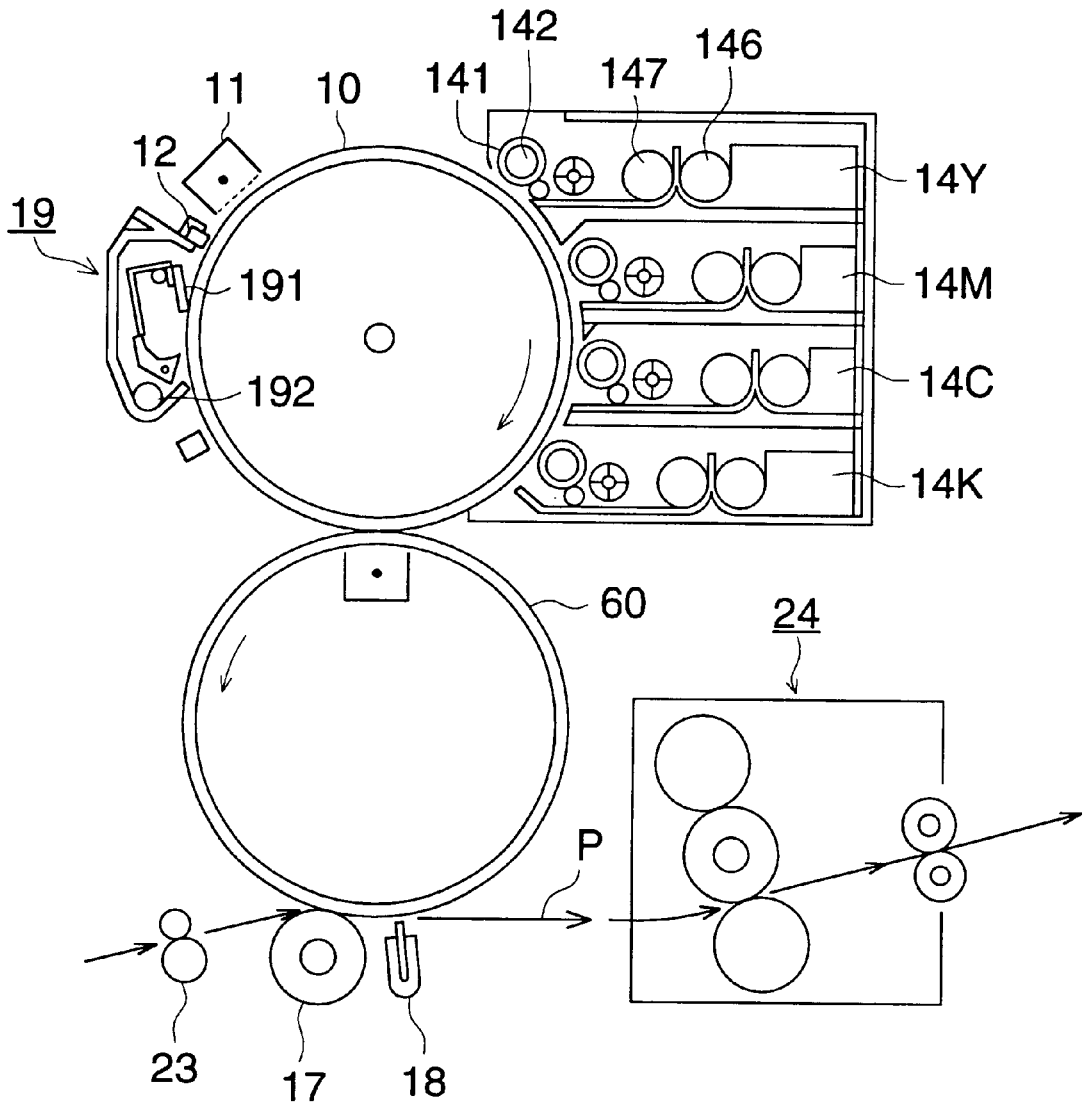
FIG. 17 is a sectional structure diagram showing still further another embodiment of a color printer equipped with a developing apparatus of the invention.

FIG. 17 is a sectional structure diagram of a color image forming apparatus which shows still another embodiment of a color printer and is equipped with developing apparatus 14 (Y, M, C and K) and with intermittent transfer drum 60.

When the intermittent transfer drum 60 is used, an electrostatic latent image formed on rotating photoreceptor drum 10 is developed by developing unit 14Y to form a Y color toner image which is then transferred onto the intermittent transfer drum 60 from the photoreceptor drum 10, and in the same way, an electrostatic latent image formed on the photoreceptor drum 10 is developed by developing unit 14M to form a M color toner image which is then transferred onto the intermittent transfer drum 60 from the photoreceptor drum 10, and then, a C color toner image and a K color toner image are transferred in succession onto the intermittent transfer drum 60 from the photoreceptor drum 10, in the same way. Further, in the transfer area where the intermittent transfer drum 60 is in contact with transfer roller 17, multi-color toner images (Y, M, C and K) are collectively transferred onto transfer sheet P electrostatically, and then, the transfer sheet P is separated by separating means 18, and images are fixed by fixing unit 24.

Each of the developing units 14Y, 14M, 14C and 14K is equipped with toner supply side stirring screw 146 and sleeve side stirring screw 147 of the invention which stir and convey developing agents.

Incidentally, application of the developing apparatus of the invention is not limited to a color image forming apparatus equipped with plural developing units, but can be applied to a monochromatic image forming apparatus having one developing unit.

In the developing apparatus, the developing method and the image forming apparatus in the invention, an improvement of stirring and conveying by a toner supply side stirring screw and a sleeve side stirring screw has made it possible to make the developing apparatus small, improved stirring property of toner supplied to the developing apparatus, and solved the problem of deterioration of developing property caused by running, thus, image density has been uniformed and stabilized, and it has become possible to obtain an image with high resolution and a well-balanced and sharp color image. In particular, deterioration of developing agents in continuous developing, insufficient amount of charging of developing agents, a fall of image density, neglected mixing of color and a fall of fine line reproducibility have been solved.

In addition, in an image forming apparatus of a reversal development system, an image forming apparatus of a non-contact development system and a color image forming apparatus wherein toner images with plural different colors are superposed on an image carrying member all of the invention, the developing apparatus mentioned above improves properties of stirring and conveying developing agents, thus, neither an amount of charging for toner nor image density falls even when a large number of prints are made continuously, and images with high image quality can be obtained.

By providing the developing agent staying preventing member for eliminating developing agents and developing toner staying on the upper portion on the side in the rotation direction of a rotary member for stirring and conveying developing agents, in the image forming apparatus of the invention, developing agents in developing units can be charged sufficiently, supplied toner can also be stirred and mixed sufficiently, and generation of non-charged or poorly charged developing agents can be restrained.

In the image forming apparatus of the invention, when a paddle wheel is arranged at a prescribed position with respect to a developing sleeve, namely, when the shortest adjoining distance T and setting angle ψ are set on a prescribed condition, it is possible to prevent the occurrence of ghost, to prevent deterioration of developing agents and to prevent the occurrence of scratches on the developing sleeve, which makes it possible to obtain images with high resolution and sharp and well-balanced color images.

What is claimed is:

1. A developing device for developing an electrostatic latent image on a photoreceptor with developer containing magnetic carrier particles and toner, wherein the developing device has A-side and B-side and the B-side is closer to the photoreceptor than the A-side, comprising:

a developing cylinder located at the B-side in close proximity to the photoreceptor so as to convey the developer toward the photoreceptor;

a first agitating conveying rotator located at the A-side for agitating said developer; and a second agitating conveying rotator located between the developing cylinder and the first agitating conveying rotator, for receiving the developer from the first agitating conveying rotator, for agitating the developer, and for conveying the developer to the developing cylinder;

the first agitating conveying rotator and the second agitating conveying rotator both rotating in the same direction to form a rotation locus, wherein the direction of a velocity vector tangent to the top of the rotation locus is directed from the B-side toward the A-side;

wherein each of the first agitating conveying rotator and the second agitating conveying rotator comprises a shaft and a screw blade extended along the shaft, the screw direction of the screw blade of the first agitating conveying rotator being opposite to that of the second agitating conveying rotator; and wherein a partition wall is provided between the first agitating conveying rotator and the second agitating conveying rotator and both ends of the partition wall are provided with ports through which the developer is conveyed between the first agitating conveying rotator and the second agitating conveying rotator.

2. The developing device of claim 1, wherein the first agitating conveying rotator and the second agitating conveying rotator both have a rotation axis parallel to the axis of the developing cylinder respectively, the first agitating conveying rotator receives toner from a toner replenishing device at one end thereof, agitates the toner with the developer and conveys the agitated developer in a first axial direction to the other end thereof, and the second agitating conveying rotator receives the agitated developer from the first agitating conveying rotator, further agitates the agitated developer and conveys the agitated developer in a second axial direction reverse to the first axial direction.

3. A developing device for developing an electrostatic latent image on a photoreceptor with a developer containing magnetic carrier particles and toner, wherein the developing device has A-side and B-side and the B-side is closer to the photoreceptor than the A-side, comprising:

a developing cylinder located at the B-side in close proximity to the photoreceptor so as to convey the developer toward the photoreceptor, a first agitating conveying rotator located at the A-side for agitating said developer;

a second agitating conveying rotator located between the developing cylinder and the first agitating conveying rotator, for receiving the developer from the first agitating conveying rotator, for agitating the developer, and for conveying the developer to the developing cylinder;

the first agitating conveying rotator and the second agitating conveying rotator both rotating in the same direction to form a rotation locus, wherein the direction of a velocity vector tangent to the top of the rotation locus is directed from the B-side toward the A-side, and a toner replenishing section through which the first agitating conveying rotator receives the toner from the toner replenishing device, wherein the toner replenishing section comprises an upper gap forming member to form an upper gap section between the upper gap forming member and the outermost rotation locus of the first agitating conveying rotator, the upper gap section is formed in a region located from the top of the rotation locus to the A-side with an angle of 20° C. to 90° C.

4. The developing device of claim 3, wherein a upper gap distance G (μm) between the upper gap forming member and the outermost rotation locus of the first agitating conveying rotator and a volume average particle diameter D (μm) of the carrier particles satisfy the following formula:

$$1 \times D \leqq C \leqq 300 \times D$$

and wherein D is 10 to 100 μm and G is 20 to 3000 μm.

5. The developing device of claim 3, wherein the upper gap forming member is used as a developing agent staying preventing member.

6. The developing device of claim 3, wherein the developer replenishing section comprises a top cover and the upper gap forming member is constructed in a single body with the top cover.

7. A developing device for developing an electrostatic latent image on a photoreceptor with a developer containing magnetic carrier particles and toner, wherein the developing device has A-side and B-side and the B-side is located closer to the photoreceptor than the A-side, comprising a developing cylinder at the B-side in close proximity to the photoreceptor so as to convey the developer toward the photoreceptor;

a first agitating conveying rotator at the A-side for agitating said developer;

a second agitating conveying rotator located between the developing sleeve and the first agitating conveying rotator, for receiving the developer from the first agitating conveying rotator, for agitating the developer, and for conveying the developer to the developing sleeve;

the first agitating conveying rotator and the second agitating conveying rotator both rotating in the same direction to form a rotation locus, wherein the direction of velocity vector tangent to the top of the rotation locus is directed from the B-side toward the A-side and a lower gap forming member located beneath the first agitating conveying rotator so as to form a lower gap section between the lower gap forming member and the outermost rotation locus of the first agitating conveying rotator, the lower gap section is formed in a region from the bottom of the rotation locus to both of the A-side and the B-side within an angle of 90° respectively, wherein a lower gap distance B (μm) between the lower gap forming member and the outermost rotation locus of the first agitating conveying rotator and a volume average particle diameter D (μm) of the carrier particles satisfy the following formula:

$$1\times D \leqq B \leqq 100\times D$$

wherein D is 10 to 100 μm and B is 20 to 1500 μm.

8. A developing device for developing an electrostatic latent image on a photoreceptor with a developer containing magnetic carrier particles and toner, wherein the developing device has A-side and B-side and the B-side is located closer to the photoreceptor than the A-side, comprising:

a developing cylinder located at the B-side in close proximity to the photoreceptor so as to convey the developer toward the photoreceptor;

a first agitating conveying rotator located at the A-side for agitating said developer; and a second agitating conveying rotator located between the developing cylinder and the first agitating conveying rotator, for receiving the developer from the first agitating conveying rotator, for agitating the developer, and for conveying the developer to the developing cylinder the first agitating conveying rotator and the second agitating conveying rotator both rotating in the same direction to form a rotation locus, wherein the direction of a velocity vector tangent to the top of the rotation locus is directed from the B-side toward the A-side, wherein the developing cylinder is rotatable and incorporates therein a repulsing magnetic field generating member by two poles having the same polarity, and the developing device further comprises a developer supplying collecting rotator which is provided between the second agitating conveying rotator and the developing cylinder and in close proximity to the repulsing magnetic field on the developing cylinder, whereby the developer supplying collecting rotator supplies the developer from the second agitating conveying rotator to the lower side of the developing cylinder and collects the developer from the upper side of the developing cylinder to the second agitating conveying rotator, and wherein the shortest distance T (μm) between the outermost rotation locus of the developer supplying collecting rotator and the developing cylinder and a volume average particle diameter D (μm) of the carrier particles satisfy the following formula:

$$D \leqq T \leqq 150\times D.$$

9. The developing device of claim 8, wherein the developer supplying collecting rotator is located such that an angle of 10° to 90° is formed below a horizontal line passing the rotation axis of the developing cylinder by a line connecting the rotation axis of the developing cylinder with the rotation axis of the developer supplying collecting rotator and the horizontal line passing the rotation axis of the developing cylinder.

10. The developing device of claim 8, wherein the rotation direction of the developer supplying collecting rotator is reverse to that of the developing cylinder at the region of the shortest distance between the outermost rotation locus of the developer supplying collecting rotator and the developing cylinder.

11. The developing device of claim 8, wherein an outer diameter of the developing cylinder is 8 mm to 60 mm.

12. The developing device of claim 8, wherein the developer supplying collecting rotator comprises a rotating shaft and a plurality of puddle blades mounted radially on the rotating shaft.

13. An apparatus for forming a toner image, comprising:

a photoreceptor;

a charging device for electrically charging the photoreceptor;

an exposing device for imagewise exposing the charged photoreceptor so as to form an electrostatic latent image on the photoreceptor; and a developing device for developing the electrostatic latent image on the photoreceptor with a developer containing magnetic carrier particles and toner, wherein the developing device has A-side and B-side and the B-side is located closer to the photoreceptor than the A-side, the developing device comprising a developing cylinder located at the B-side in close proximity to the photoreceptor so as to convey the developer toward the photoreceptor;

a first agitating conveying rotator located at the A-side and for agitating developer; and a second agitating conveying rotator located between the developing cylinder and the first agitating conveying rotator, for receiving the developer from the first agitating conveying rotator, for agitating the developer, and for conveying the developer to the developing cylinder;

the first agitating conveying rotator and the second agitating conveying rotator both rotating in the same direction to form a rotation locus, wherein the direction of velocity vector tangent to the top of the rotation locus is directed from the B-side toward the A-side, wherein each of the first agitating conveying rotator and the second agitating conveying rotator comprises a shaft and a screw blade extended along the shaft and the screw direction of the screw blade of the first agitating conveying rotator being opposite to that of the second agitating conveying rotator; and wherein a partition wall is provided between the first agitating conveying rotator and the second agitating conveying rotator and both ends of the partition wall are provided with ports through which the developer is conveyed between the first agitating conveying rotator and the second agitating conveying rotator.

14. The apparatus of claim 13, wherein the developer contains magnetic carrier particles and toner and the developing cylinder is rotatable and incorporates therein a repulsing magnetic field generating member by two poles having the same polarity, and wherein the developing device further comprises a developer supplying collecting rotator which is provided between the second agitating conveying rotator and the developing cylinder and located in close proximity to the repulsing magnetic field on the developing cylinder, whereby the developer supplying collecting rotator supplies the developer from the second agitating conveying rotator to the lower side of the developing cylinder and collects the developer from the upper side of the developing cylinder to the second agitating conveying rotator.

15. The apparatus of claim 14, wherein the developer supplying collecting rotator is located such that an angle of 10° to 90° is formed below a horizontal line passing the rotation axis of the developing cylinder by a line connecting the rotation axis of the developing cylinder with the rotation axis of the developer supplying collecting rotator and the horizontal line passing the rotation axis of the developing cylinder.

16. An apparatus for forming a toner image, comprising:

a photoreceptor;

a charging device for electrically charging the photoreceptor;

an exposing device for imagewise exposing the charged photoreceptor so as to form an electrostatic latent image on the photoreceptor; and a developing device for developing the electrostatic latent image on the photoreceptor with developer containing magnetic carrier particles and toner, wherein the developing device has A-side and B-side and the B-side is located closer to the photoreceptor than the A-side, the developing device comprising a developing cylinder located at the B-side in close proximity to the photoreceptor so as to convey the developer toward the photoreceptor;

a first agitating conveying rotator located at the A-side and for agitating developer;

a second agitating conveying rotator located between the developing sleeve and the first agitating conveying rotator, for receiving the developer from the first agitating conveying rotator, for agitating the developer, and for conveying the developer to the developing sleeve;

the first agitating conveying rotator and the second agitating conveying rotator both rotating in the same direction to form a rotation locus, wherein the direction of a velocity vector tangent to the top of the rotation locus is directed from the B-side toward the A-side, and a toner replenishing section through which the first agitating conveying rotator receives the toner from the toner replenishing device, and wherein the toner replenishing section comprises an upper gap forming member to form an upper gap section between the upper gap forming member and the outermost rotation locus of the first agitating conveying rotator, the upper gap section is formed in a region located from the top of the rotation locus to the A-side with an angle of 20° C. to 90° C.

* * * * *